US012798852B2

(12) United States Patent
Bottini et al.

(10) Patent No.: US 12,798,852 B2
(45) Date of Patent: Nov. 17, 2026

(54) PACKAGE AND PROCESS OF MAKING SAID PACKAGE

(71) Applicant: Cryovac, LLC, Charlotte, NC (US)

(72) Inventors: Silvia Bottini, Lissone (IT); Riccardo Palumbo, Arona (IT); Giulio Benedetti, Solbiate Arno (IT)

(73) Assignee: Cryovac, LLC, Charlotte, NC (US)

( * ) Notice: Subject to any disclaimer, the term of this patent is extended or adjusted under 35 U.S.C. 154(b) by 91 days.

(21) Appl. No.: 18/568,327

(22) PCT Filed: May 12, 2022

(86) PCT No.: PCT/EP2022/062967
§ 371 (c)(1),
(2) Date: Dec. 8, 2023

(87) PCT Pub. No.: WO2022/258305
PCT Pub. Date: Dec. 15, 2022

(65) Prior Publication Data

US 2024/0270469 A1 Aug. 15, 2024

(30) Foreign Application Priority Data

Jun. 9, 2021 (EP) ..... 21178437

(51) Int. Cl.
*B65D 75/58* (2006.01)
*B65B 43/04* (2006.01)
(Continued)

(52) U.S. Cl.
CPC ..... *B65D 75/5805* (2013.01); *B65B 43/04* (2013.01); *B65B 51/18* (2013.01);
(Continued)

(58) Field of Classification Search
CPC ..... B65B 43/04; B65B 51/18; B65B 53/02; B65B 57/00; B65D 75/5805; B65D 75/002; B65D 75/326
(Continued)

(56) References Cited

U.S. PATENT DOCUMENTS 2,622,986 A * 12/1952 Snyder ..... B65D 75/54 383/906
2,851,212 A * 9/1958 Parmer ..... B65D 75/5805 383/200
(Continued)

FOREIGN PATENT DOCUMENTS

CN 207015694 U 2/2018
DE 3924871 A1 2/1991
(Continued)

OTHER PUBLICATIONS https://sealstrip.com/, downloaded on or prior to May 13, 2021.
(Continued)

*Primary Examiner* — Sameh Tawfik
(74) *Attorney, Agent, or Firm* — Jason R. Womer

(57) ABSTRACT

It is described a package comprising a plastic bag delimiting a seat sealingly housing a product; the plastic bag has plastic film walls and at least one sealing band connecting together opposed wall portions of the plastic film walls at a connecting zone of the plastic bag; a tab is coupled with the connecting zone of the plastic bag: the tab includes an easy opening feature at one or more of its perimeter edges. A process of making packages of the above type is also described.

6 Claims, 20 Drawing Sheets

(51) Int. Cl.

| | |
|---|---|
| ***B65B 51/18*** | (2006.01) |
| ***B65B 53/02*** | (2006.01) |
| ***B65B 57/00*** | (2006.01) |
| ***B65D 75/00*** | (2006.01) |
| ***B65D 75/32*** | (2006.01) |

(52) U.S. Cl.
CPC ..... *B65B 53/02* (2013.01); *B65B 57/00* (2013.01); *B65D 75/002* (2013.01); *B65D 75/326* (2013.01)

(58) Field of Classification Search
USPC ..... 383/200
See application file for complete search history.

(56) References Cited

U.S. PATENT DOCUMENTS

| | | | | |
|---|---|---|---|---|
| 3,011,295 | A | 12/1961 | Brugger | |
| 3,087,610 | A * | 4/1963 | Kirkpatrick | B65D 71/08 53/442 |
| 3,156,812 | A | 11/1964 | Forman | |
| 3,312,811 | A | 4/1967 | Shanklin | |
| 3,378,988 | A * | 4/1968 | McClosky | B65B 9/12 426/115 |
| 3,424,306 | A * | 1/1969 | Munck | B65D 73/00 206/466 |
| 3,430,358 | A | 3/1969 | Denker | |
| 3,512,332 | A | 5/1970 | Klein | |
| 3,552,088 | A | 1/1971 | Niwa | |
| 3,863,837 | A * | 2/1975 | Spiegel | B65D 71/10 53/442 |
| 3,921,805 | A * | 11/1975 | Compere | B65D 75/5855 206/532 |
| 4,016,026 | A | 4/1977 | Grevich | |
| 4,204,379 | A | 5/1980 | Mugnai | |
| 4,219,988 | A * | 9/1980 | Shanklin | B29C 66/4322 53/374.6 |
| 4,457,122 | A * | 7/1984 | Atkins | B65B 31/024 53/442 |
| 4,580,393 | A * | 4/1986 | Furukawa | B65B 31/022 53/512 |
| 4,597,247 | A | 7/1986 | Johnson | |
| 4,896,770 | A * | 1/1990 | Calcerano | B65D 75/32 206/459.5 |
| 4,958,735 | A | 9/1990 | Odabashian | |
| 5,060,803 | A * | 10/1991 | Beer | B65D 75/58 383/906 |
| 5,169,696 | A * | 12/1992 | Lang | B65D 75/58 428/347 |
| 5,475,969 | A | 12/1995 | Sowden | |
| 5,546,677 | A | 8/1996 | Tolson | |
| 6,106,935 | A | 8/2000 | Lambert et al. | |
| 6,221,470 | B1 | 4/2001 | Ciocca et al. | |
| 6,299,984 | B1 | 10/2001 | Forloni | |
| 6,343,876 | B2 * | 2/2002 | Takahashi | B29C 66/4322 116/DIG. 17 |
| 6,602,455 | B1 | 8/2003 | Forloni | |
| 6,962,033 | B2 * | 11/2005 | Guzman | B29C 66/8242 53/550 |
| 7,155,876 | B2 * | 1/2007 | Vander | B65B 61/12 34/216 |
| D567,668 | S * | 4/2008 | Lin | D9/707 |
| 7,380,664 | B2 * | 6/2008 | Suzuki | A47F 5/08 211/85.15 |
| 7,823,366 | B2 * | 11/2010 | Schoeneck | B29C 66/73715 53/442 |
| 7,857,135 | B2 * | 12/2010 | Martin | B65D 75/545 206/541 |
| 8,333,510 | B2 * | 12/2012 | Ackermann | B65D 75/5855 206/532 |
| 8,562,216 | B2 * | 10/2013 | Kendall | B65D 27/14 383/207 |
| 9,162,087 | B2 * | 10/2015 | Damlo | A62B 25/005 |
| 11,407,537 | B2 | 8/2022 | Chevalier et al. | |
| 11,407,571 | B2 | 8/2022 | Taglini | |
| 11,414,228 | B2 | 8/2022 | Palumbo et al. | |
| 11,660,385 | B1 * | 5/2023 | Thakore | B65D 65/22 206/364 |
| 12,291,387 | B2 * | 5/2025 | Nash | B65D 75/008 |
| 2001/0014187 | A1 * | 8/2001 | Takahashi | B29C 66/83513 383/200 |
| 2002/0073661 | A1 | 6/2002 | Nolan | |
| 2003/0223653 | A1 | 12/2003 | Knoerzer et al. | |
| 2004/0013322 | A1 | 1/2004 | Taylor | |
| 2004/0128957 | A1 | 7/2004 | Guzman | |
| 2004/0231301 | A1 | 11/2004 | Vandertuin et al. | |
| 2005/0193690 | A1 | 9/2005 | Schoeneck | |
| 2006/0107622 | A1 | 5/2006 | James et al. | |
| 2007/0221532 | A1 * | 9/2007 | DiLiberto | B65D 81/2023 206/812 |
| 2008/0314787 | A1 * | 12/2008 | Martin | B65D 75/545 206/542 |
| 2009/0017239 | A1 * | 1/2009 | Ursino | B32B 27/08 428/34.9 |
| 2009/0049803 | A1 | 2/2009 | Limousin | |
| 2009/0116768 | A1 * | 5/2009 | Huerta | B32B 27/308 383/207 |
| 2012/0233965 | A1 | 9/2012 | Riccio et al. | |
| 2018/0319523 | A1 * | 11/2018 | Palumbo | B65B 51/16 |
| 2019/0193881 | A1 * | 6/2019 | Pecherskiy | B65B 31/024 |
| 2021/0221591 | A1 * | 7/2021 | Huffer | B65D 75/5855 |
| 2023/0128342 | A1 * | 4/2023 | Neagu | B65D 85/10 396/461 |
| 2023/0399158 | A1 * | 12/2023 | Schäfer | B41M 5/0047 |
| 2024/0116679 | A1 * | 4/2024 | Torriglia | B65D 31/10 |

FOREIGN PATENT DOCUMENTS

| | | | |
|---|---|---|---|
| EP | 1050466 | A1 | 11/2000 |
| EP | 2805821 | A1 | 11/2014 |
| GB | 934389 | A | 8/1963 |
| GB | 1382842 | A | 2/1975 |
| GB | 2246110 | A | 1/1992 |
| WO | 2020094267 | A1 | 5/2020 |

OTHER PUBLICATIONS https://www.kemiplast.it/en/easy-opening-with-laser/, downloaded on or prior to May 13, 2021.
http://www.mastertechnologies.eu/index-13-Easy.html, downloaded on or prior to May 13, 2021.
https://www.indiamart.com/essentra-packaging/open-easy-opening.html, downloaded on or prior to May 13, 2021.

* cited by examiner

FIG.1
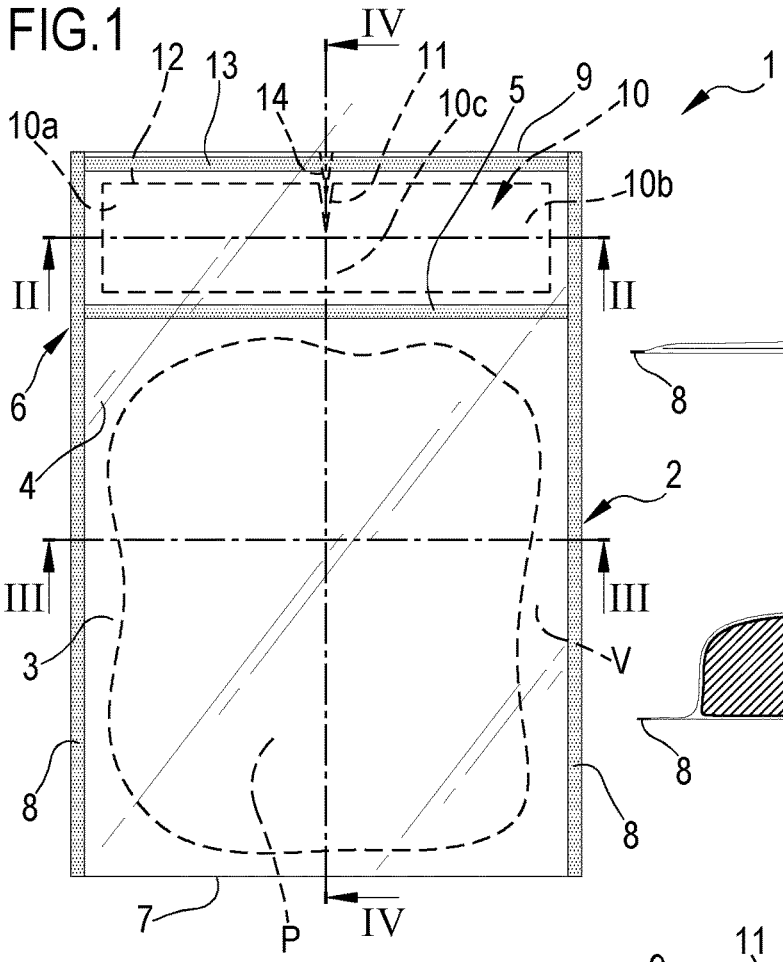
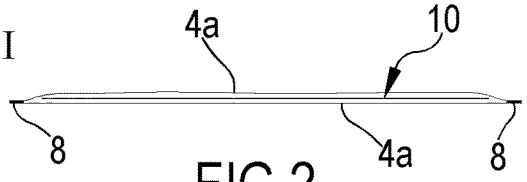
FIG.2
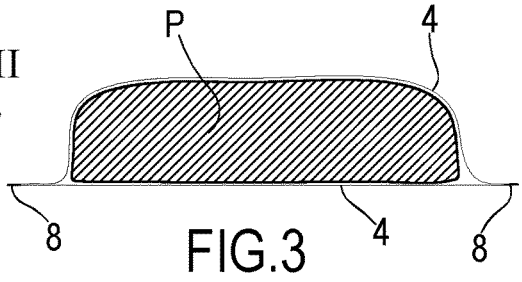
FIG.3
FIG.4
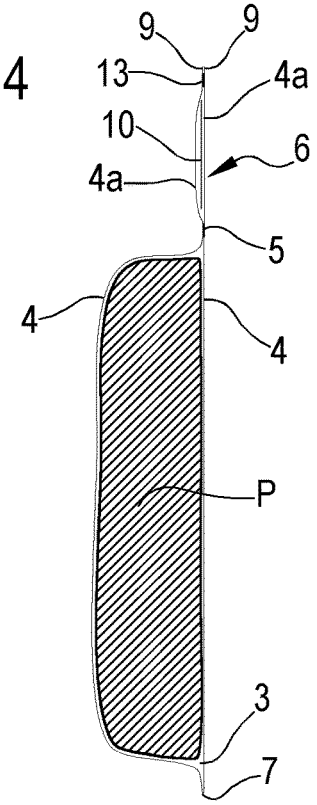
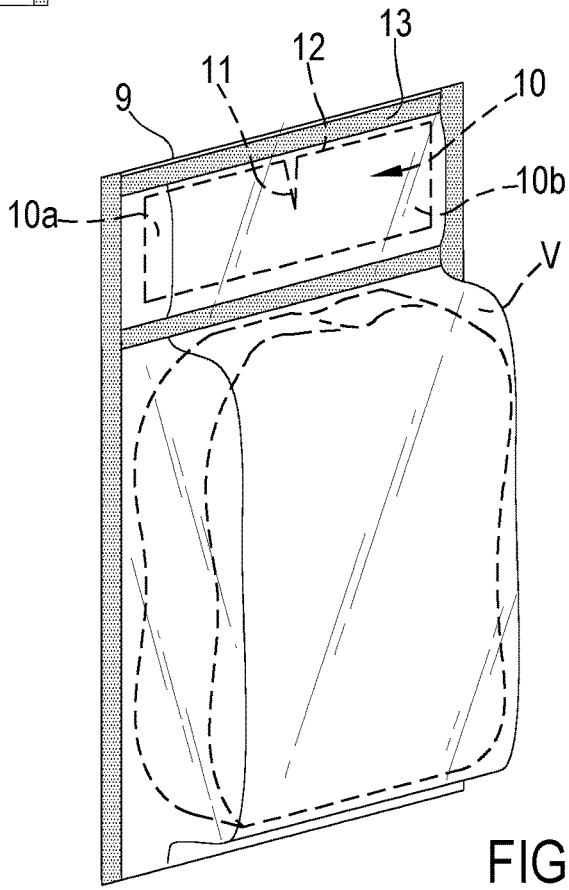
FIG.5

FIG.6
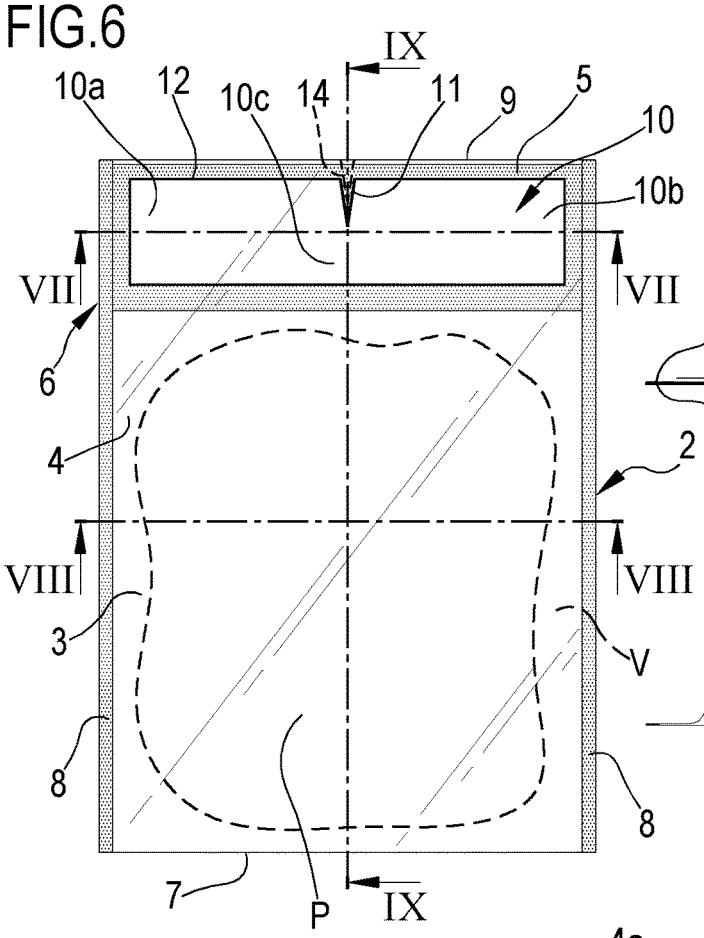
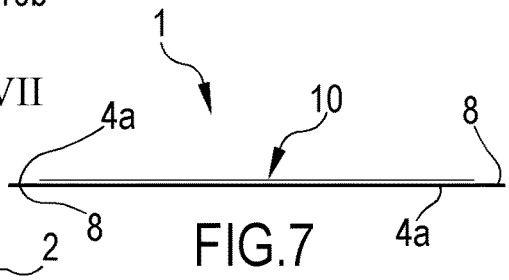
FIG.7
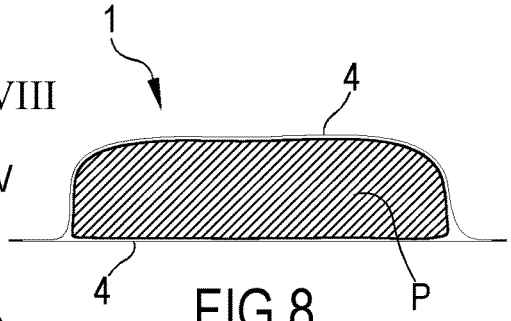
FIG.8
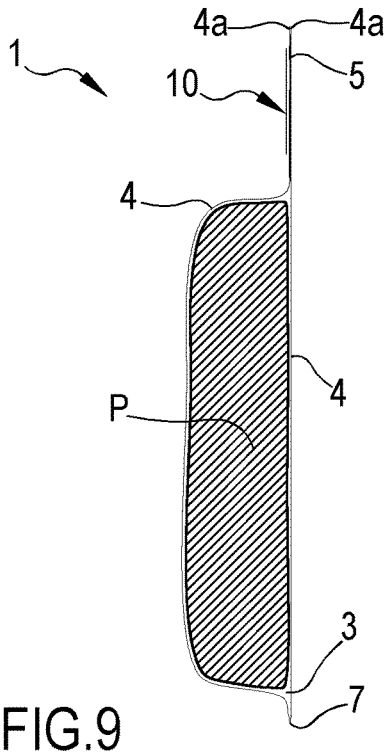
FIG.9
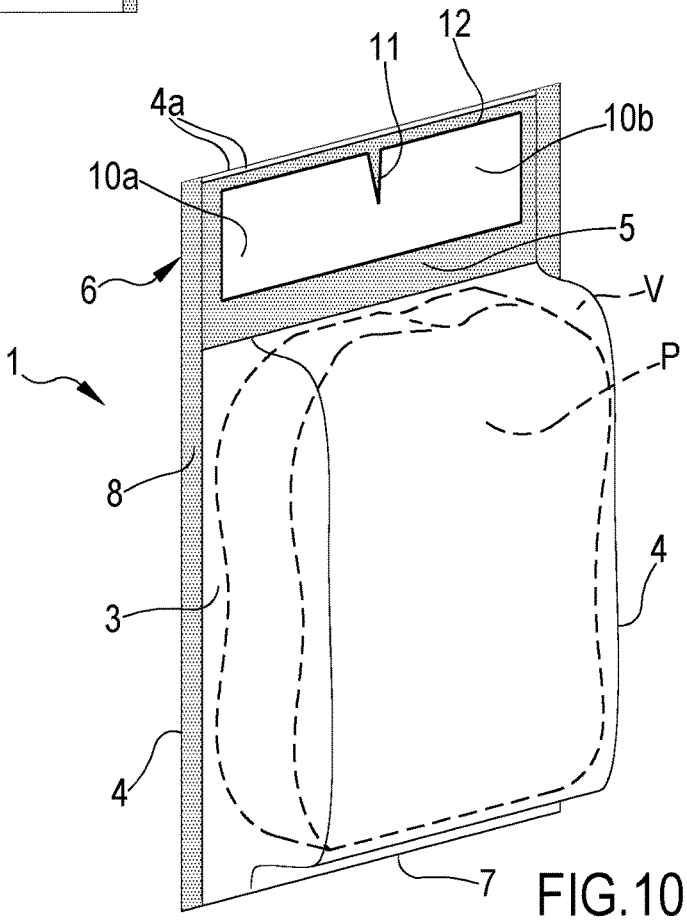
FIG.10

PACKAGE AND PROCESS OF MAKING SAID PACKAGE

FIELD OF THE INVENTION

The present invention relates to a package, in particular for containing products, for example of a food type. The invention also relates to a process and a relative apparatus for manufacturing the mentioned package using a plastic film. The invention may have application in vacuum packaging or in controlled atmosphere packaging of products of various type.

BACKGROUND ART

In the food packaging field, plastic films are used to form packages. The plastic film wraps and protects the product also allowing the consumer to see the product and thus visually assess product features such as size, shape, and quality of the product. Plastic packages used in the packaging of food include a bag of plastic material into which the food product is inserted. The plastic bag is then sealed.

Although plastic bags are widely used, prior art solutions suffer from a number of drawbacks.

Primarily, plastic foils used to wrap products are generally relatively thick in order to provide a resistant enclosure for the product, thus resulting in the generation of relevant quantities of waste material. Additionally, plastic wraps used to package products are often difficult to open or require relatively complex designs in order to offer a package with a facilitated opening system. Finally, plastic material used to wrap products often results in packages of scarce aesthetic properties and/or not susceptible of receiving prints.

OBJECT OF THE INVENTION

The object of the present invention is to solve the drawbacks and/or limitations of the above prior art.

A first object of the invention is to provide a package having an effective facilitated opening system to allow the user a simple and quick opening of the package.

Furthermore, it is an object of the present invention to provide a package that provides the user with a visual or tactile perception of the facilitated opening system.

A further object of the present invention is to provide a package substantially in the form of a plastic bag using a reduced quantity of plastic, yet guaranteeing and efficient and robust packaging.

Another object of the invention is a package of simple and cost-effective structure which at the same time can ensure a convenient and stable handling of the package during the opening of the latter.

An additional object is that of offering a package suitable for carrying prints, drawings, images and the like.

A yet further object is to provide process and apparatus for effectively making the mentioned package.

These and yet other objects, which will become more apparent from the following description, are substantially achieved by a package, an apparatus and a related process for manufacturing the package according to one or more of the accompanying claims and/or the following aspects.

SUMMARY

A 1$^{st}$ aspect concerns a package comprising:

a plastic bag (2) delimiting a seat (3) sealingly housing a product (P), the plastic bag (2) having one or more plastic film walls (4), and at least one connecting zone (6; 6*a*, 6*b*) comprising at least one sealing band (5; 5, 13; 5*a*; 5*a*, 13*a*) connecting together mutually facing wall portions (4*a*) of said plastic film walls (4).

In a 2$^{nd}$ aspect according to the 1$^{st}$ aspect the package comprises a tab (10) coupled with the at least one connecting zone (6; 6*a*, 6*b*) of the plastic bag (2).

In a 3$^{rd}$ aspect according to the 2$^{nd}$ aspect the tab (10) includes an easy opening feature (11) at one or more of its perimeter edges.

In a 4$^{th}$ aspect according to any one of the preceding two aspects the tab (10) is a body distinct from the plastic bag (2).

In a 5$^{th}$ aspect according to any one of the preceding two aspects the easy opening feature (11) is a notch, a cut, or a weakening line extending across a portion of the tab (10).

In a 6$^{th}$ aspect according to the 5$^{th}$ aspect the notch, cut or weakening line is oriented towards said seat (3).

In a 7$^{th}$ aspect according to any one of the preceding aspects the at least one connecting zone (6; 6*a*, 6*b*) of the plastic bag (2) comprises mutually facing ends of the plastic film walls (4) connected by said at least one sealing band (5; 5, 13; 5*a*, 13*a*).

In a 8$^{th}$ aspect according to any one of the preceding aspects the plastic bag (2) is made from a plastic sheet (i.e. from one plastic element in sheet form which may be formed by one layer or by multiple overlapping layers attached to each other) bent along a bend zone (7) forming two mutually facing plastic film walls (4) having first ends connected at the bend zone (7) and second ends, opposed to the first ends and distal with respect to the bend zone (7), with said product located in a volume (V) between said first ends and said second ends of the mutually facing plastic film walls (4).

In a 9$^{th}$ aspect according to the preceding aspect the bend zone is in the form of a fold line.

In a 10$^{th}$ aspect according to any one of the preceding two aspects the at least one connecting zone is a connecting zone (6) including:

mutually facing wall portions (4*a*) of the second ends of the plastic film walls (4) of the same single plastic film;

said at least one sealing band (5; 5, 13) connecting together the mutually facing wall portions (4*a*) of the second ends of the plastic film walls (4), distally with respect to the bend zone (7).

In an 11$^{th}$ aspect according to the 8$^{th}$ or 9$^{th}$ aspect the at least one connecting zone (6*a*, 6*b*) comprises:

a first connecting zone (6*a*) including mutually facing wall portions (4*a*) of the first ends of the plastic film walls (4), and said at least one sealing band (5*a*; 5*a*, 13*a*) extending at a distance from said bend zone (7), optionally in a direction parallel to said bend zone (7), a second connecting zone (6*b*) including mutually facing wall portions of second ends of the plastic walls (4), and a respective further sealing band (5*b*).

In a 12$^{th}$ aspect according to any one of the preceding two aspects the at least one sealing band (5; 5, 13; 5*a*; 5*a*, 13*a*) extends along or adjacent to or parallel to a peripheral border (9) of the opposed plastic film walls (4).

In a 13$^{th}$ aspect according to the preceding aspect the easy opening feature (11) is oriented transversally, optionally is perpendicular, to the at least one sealing band (5, 5; 13; 5*a*, 5*a*, 13*a*).

In a 14$^{th}$ aspect according to any one of the preceding aspects from the 2$^{nd}$ to the 13$^{th}$ each of the wall portions (4*a*)

presents an inner surface, facing the inner surface of the opposed wall portion, and an opposed outer surface, wherein:

the tab (10) is a thin strip with opposed prevalent surfaces.

In a 15$^{th}$ aspect according to any one of the preceding aspects from the 2$^{nd}$ to the 14$^{th}$ each of the wall portions (4*a*) presents an inner surface, facing the inner surface of the opposed wall portion, and an opposed outer surface, wherein:

the tab (10) is coupled with the connecting zone (6; 6*a*) of the plastic bag (2) such that:

one of the tab prevalent surfaces intimately adheres to one of the inner surfaces of the wall portions (4*a*).

In a 16$^{th}$ aspect according to any one of the preceding aspects from the 2$^{nd}$ to the 14$^{th}$ each of the wall portions (4*a*) presents an inner surface, facing the inner surface of the opposed wall portion, and an opposed outer surface, wherein:

the tab (10) is coupled with the connecting zone (6; 6*a*) of the plastic bag (2) such that:

each one of the tab prevalent surfaces intimately adheres to a respective one of the inner surfaces of the wall portions (4*a*).

In a 17$^{th}$ aspect according to any one of the preceding aspects from the 2$^{nd}$ to the 14$^{th}$ each of the wall portions (4*a*) presents an inner surface, facing the inner surface of the opposed wall portion, and an opposed outer surface, wherein:

the tab (10) is coupled with the connecting zone (6; 6*a*) of the plastic bag (2) such that:

one of the tab prevalent surfaces has a portion that intimately adheres to the outer surface of one of the wall portions (4*a*) and a consecutive portion that adheres to the outer surface of the other of the wall portions (4*a*).

In an 18$^{th}$ aspect according to any one of the preceding aspects from the 2$^{nd}$ to the 17$^{th}$:

in accordance with a first alternative, the tab (10) is sandwiched between the inner surfaces of the wall portions (4*a*) of the plastic bag (2); or in accordance with a second alternative, the tab (10) is fixed, in particular adhesively or heat bonded, to the outer surface one or both of the wall portions (4*a*).

In a 19$^{th}$ aspect according to the preceding aspect, first alternative, wherein the least one sealing band comprises a first sealing band (5; 5*a*) and a second sealing band (13; 13*a*) positioned at the connecting zone (6; 6*a*, 6*b*) and located at a distance the one from the other, with the tab (10) being, on its turn, positioned between the first sealing band (5; 5*a*) and the second sealing band (13; 13*a*) in particular wherein the first and second sealing bands are parallel to each other.

In a 20$^{th}$ aspect according to the preceding aspect:

both the first sealing band (5) and the second sealing band (13) connect together the mutually facing wall portions (4*a*) of the second ends of the plastic film walls (4), one of said first and second sealing bands (5, 13) is a continuous band extending across a width of the plastic bag and gas tightly sealing the seat (3) from an environment external to the plastic bag (2), the other of said first and second sealing bands (5, 13) is either a continuous sealing band extending across the width of the plastic bag or a discontinuous sealing band comprising sealing zones intercalated by non-sealing zones.

In a 21$^{st}$ aspect according to the preceding aspect the easy opening feature (11), in particular the notch or the cut or weakening line, extends from an edge (12) of the tab (10) distal with respect to the bend zone (7).

In a 22$^{nd}$ aspect according to the 19$^{th}$ aspect:

both the first sealing band (5*a*) and the second sealing band (13*a*) connect together the mutually facing wall portions (4*a*) of the first ends of the plastic film walls (4), each one of said first and second sealing bands (5, 13) being either a continuous band extending across a width of the plastic bag and gas tightly sealing the seat (3) from an environment external to the plastic bag (2) or a discontinuous sealing band comprising sealing zones intercalated by non-sealing zones.

In a 23$^{rd}$ aspect according to the preceding aspect the easy opening feature (11), in particular the notch or the cut or weakening line, extends from an edge (12) of the tab (10) proximal with respect to the bend zone (7).

In a 24$^{th}$ aspect according to the 18$^{th}$ aspect, first alternative:

the at least one sealing band comprises a single sealing band (5*a*) connecting together the mutually facing wall portions (4*a*) of the first ends of the plastic film walls (4), said single sealing band (5*a*) is either a continuous sealing band extending across the width of the plastic bag or a discontinuous sealing band comprising sealing zones intercalated by non-sealing zones.

In a 25$^{th}$ aspect according to the preceding aspect the easy opening feature (11), in particular the notch or the cut or weakening line, extends from an edge (12) of the tab (10) proximal with respect to the bend zone (7).

In a 26$^{th}$ aspect according to the 18$^{th}$ aspect, second alternative, the least one sealing band comprises a sealing band (5; 5*a*), in particular a single sealing band, positioned at the connecting zone (6; 6*a*, 6*b*) with the tab (10) being fixed, in particular adhesively or heat bonded, onto the sealing band (5, 5*a*).

In a 27$^{th}$ aspect according to the preceding aspect:

the sealing band (5*a*) connects together the mutually facing wall portions (4*a*) of the first ends of the plastic film walls (4), said sealing band (5*a*) is a continuous band extending across a width of the plastic bag (2) or a discontinuous sealing band comprising sealing zones intercalated by non-sealing zones.

In a 28$^{th}$ aspect according to the preceding aspect the easy opening feature (11), in particular the notch or the cut or weakening line, extends from an edge (12) of the tab (10) proximal with respect to the bend zone (7).

In a 29$^{th}$ aspect according to the 26$^{th}$ aspect:

the sealing band (5) connects together the mutually facing wall portions (4*a*) of the second ends of the plastic film walls (4), said sealing band (5) is a continuous band extending across a width of the plastic bag gas tightly sealing the seat (3) from an environment external to the plastic bag (2).

In a 30$^{th}$ aspect according to the preceding aspect the easy opening feature (11), in particular the notch or the cut or weakening line, extends from an edge (12) of the tab (10) distal with respect to the bend zone (7).

In a 31$^{st}$ aspect according to any one of aspects from the 2$^{nd}$ to the 30$^{th}$, the tab (10) comprises:

a single tab element adhering above the outer surface of one of said wall portions, with the easy opening feature (11), in particular the notch or tab the weakening line, extending from the edge (12) of the single tab element.

In a 32$^{nd}$ aspect according to any one of aspects from the 2$^{nd}$ to the 30$^{th}$, the tab (10) comprises:

two separate tab elements each adhering on the outer surface of one respective wall portion (4*a*), with a respective easy opening feature (11), in particular notch or cut or weakening line, extending from the edge (12) of each tab element.

In a 33$^{rd}$ aspect according to any one of aspects from the 2$^{nd}$ to the 30$^{th}$, the tab (10) comprises:

two tab elements connected at a fold line of the tab, each tab element adhering on the outer surface of one respective wall portion (4*a*), with a respective easy opening feature (11), in particular notch or cut or weakening line, extending from the fold line of the tab.

In a 34$^{th}$ aspect according to any one of the preceding aspects the plastic bag (2) is a vacuumized bag wherein inner surfaces of the film wall portions (4*a*) adhere to the product (P).

In a 35$^{th}$ aspect according to any one of the preceding aspects the at least one sealing band (5; 5, 13; 5*a*; 5*a*, 13*a*) has a length in a direction of prevalent development and has a width measured perpendicular to the direction of prevalent development which is significantly smaller than the length.

In a 36$^{th}$ aspect according to the preceding aspect the easy opening feature (11) present in the tab (10), in particular the notch or weakening line, extends above at least 25%, or at least 50%, of the width of the sealing band (5; 5, 13; 5*a*; 5*a*, 13*a*).

In a 37$^{th}$ aspect according to any one of the preceding aspects the bag is made of a heat-shrinkable plastic film showing a free shrinking value at 120° C. (value measured in accordance with ASTM D2732, in oil) in the range from 2% to 80% in both longitudinal and transverse directions.

In a 38$^{th}$ aspect according to any one of the preceding aspects the bag is made of a heat-shrinkable plastic film showing a free shrinking value at 120° C. (value measured in accordance with ASTM D2732, in oil) in the range from 5% to 60% in both longitudinal and transverse directions.

In a 39$^{th}$ aspect according to any one of the preceding aspects the bag is made of a heat-shrinkable plastic film showing a free shrinking value at 120° C. (value measured in accordance with ASTM D2732, in oil) in the range from 10% to 40% in both longitudinal and transverse directions.

In a 40$^{th}$ aspect according to any one of the preceding aspects from the 2$^{nd}$ to the 39$^{th}$ the tab (10) is made, in particular entirely made, of paper.

In a 41$^{st}$ aspect according to any one of the preceding aspects from the 2$^{nd}$ to the 39$^{th}$ the tab (10) is made, in particular entirely made, of paperboard.

In a 42$^{nd}$ aspect according to any one of the preceding aspects from the 2$^{nd}$ to the 39$^{th}$ the tab (10) is made, in particular entirely made, of non-heat-shrinkable plastic material.

In a 43$^{rd}$ aspect according to any one of the preceding aspects from the 2$^{nd}$ to the 39$^{th}$ the tab (10) is made, in particular entirely made of PE.

In a 44$^{th}$ aspect according to any one of the preceding aspects the bag is made of plastic film material having thickness comprised between 10 and 60 μm.

In a 45$^{th}$ aspect according to any one of the preceding aspects the bag is made of plastic film material having thickness comprised between 15 and 45 μm.

In a 46$^{th}$ aspect according to any one of the preceding aspects the bag is made of plastic film material having thickness comprised between 20 and 35 μm.

In a 47$^{th}$ aspect according to any one of the preceding aspects from the 2$^{nd}$ to the 46$^{th}$ the tab (10) has thickness greater than the thickness of the plastic film material forming the plastic bag (2).

In a 48$^{th}$ aspect according to any one of the preceding aspects from the 2$^{nd}$ to the 47$^{th}$ the thickness of the tab (10) is between 35 and 400 μm.

In a 49$^{th}$ aspect according to any one of the preceding aspects from the 2$^{nd}$ to the 48$^{th}$ the tab (10) comprises a first and second flap, adjacent to each other, and wherein said easy opening feature (11) extends in correspondence of a tab intermediate region between the first and second flaps.

In a 50$^{th}$ aspect according to any one of the preceding aspects from the 2$^{nd}$ to the 49$^{th}$ said easy opening feature (11) is a notch.

In a 51$^{st}$ aspect according to any one of the preceding aspects from the 2$^{nd}$ to the 49$^{th}$ said easy opening feature (11) is a cut.

In a 52$^{nd}$ aspect according to any one of the preceding aspects from the 2$^{nd}$ to the 49$^{th}$ said easy opening feature (11) is a weakening line.

In a 52$^{nd}$ aspect according to any one of the preceding four aspects said first and second flaps are operable by a user to move from a substantially coplanar condition to an angularly offset apart condition, wherein moving the first and second flaps to the angularly offset condition causes propagation of a fracture line from the easy opening feature (11) across the tab (10) and then formation of a rupture across the plastic bag connecting zone (6; 6*a*, 6*b*).

In a 53$^{rd}$ aspect according to any one of the preceding five aspects said first and second flaps are operable by a user to move from a substantially coplanar condition to an angularly offset and teared apart condition, wherein moving the first and second flaps to the angularly offset and teared apart condition causes propagation of a fracture line from the easy opening feature (11) across the tab (10) and then formation of a rupture across the plastic bag connecting zone (6; 6*a*, 6*b*).

In a 54$^{th}$ aspect according to any one of the preceding aspects from the 49$^{th}$ to the 52$^{nd}$ said first and second flaps are operable by a user to move from a substantially coplanar condition to a teared apart condition, wherein moving the first and second flaps to the teared apart condition causes propagation of a fracture line from the easy opening feature (11) across the tab (10) and then formation of a rupture across the plastic bag connecting zone (6; 6*a*, 6*b*).

In a 55$^{th}$ aspect according to any one of the preceding aspects the plastic bag (2) comprises a further easy opening feature (14), which is formed in the plastic material of the plastic bag (2).

In a 56$^{th}$ aspect according to the 55$^{th}$ aspect the further easy opening feature (14) is a further notch.

In a 57$^{th}$ aspect according to the 55$^{th}$ aspect the further easy opening feature (14) is a further cut.

In a 58$^{th}$ aspect according to the 55$^{th}$ aspect the further easy opening feature (14) is a further weakening line.

In a 59$^{th}$ aspect according to any one of the preceding four aspects the further easy opening feature (14) is formed in the plastic material of the plastic bag (2) and extends from a peripheral border (9) of the plastic bag (2).

In a 60$^{th}$ aspect according to any one of the preceding five aspects the further easy opening feature (14) is either adjacent to the connecting zone (6; 6*a*, 6*b*) of the plastic bag (2) or partly crosses the connecting zone (6).

In a 61st aspect according to any one of the preceding six aspects the further easy opening feature (14) partly or completely crosses at least one sealing band (5; 5, 13; 5*a*; 5*a*, 13*a*) of the plastic bag (2).

In a 62nd aspect according to any one of the preceding seven aspects the further easy opening feature (14), in particular the further notch or further cut or further weakening line is oriented towards said seat (3).

In a 63rd aspect according to any one of the preceding eight aspects the further easy opening feature (14), in particular the further notch or further cut or further weakening line is aligned with said notch or cut or weakening line present in the tab (10).

In a 64th aspect according to any one of the preceding aspects the plastic bag (2) joined together at the connecting zone (6; 6*a*, 6*b*) and also joined together at side edges by transverse sealing bands (8) extending from the bend zone (7) to the at least one sealing band (5).

A 65th aspect concerns a process of making packages each containing at least one respective product (P).

A 66th aspect concerns a process of making packages wherein each package is according to any one of aspects from the 1st to the 64th.

A 67th aspect concerns a process of making packages according to any one of the preceding two aspects comprising:

advancing a plastic film (23) along an operating path, forming a plurality of plastic bags (2) from the plastic film (23), each of said plastic bags (2) hosting a respective product (P), obtaining from each of said plastic bags (2) a package according to any one of the preceding aspects from the 1st to the 64th.

In a 68th aspect according to any one of the preceding three aspects the process comprises a step of positioning a respective tab (10) in correspondence of the at least one connecting zone (6; 6*a*, 6*b*) of each plastic bag (2).

In a 69th aspect according to any one of aspects from the 65th to the 67th the process comprises a step of positioning a respective tab (10) in correspondence of an area of the plastic film (23) destined to form said at least one connecting zone (6; 6*a*, 6*b*) of each plastic bag (2).

In a 70th aspect according to any one of the preceding three aspects the products (P) to be packaged are advanced along the operating path together with the plastic film (23), the plastic film (23) being positioned around the products (P) before formation of the plastic bags (2).

In a 71st aspect according to any one of the preceding four aspects the operating path is horizontal or vertical.

In a 72nd aspect according to any one of the preceding five aspects the plastic film (23) is a continuous plastic film, optionally unrolled from a feed roll (24), which is shaped into a tubular or in an almost tubular film structure receiving the products (P).

In a 73rd aspect according to the preceding aspect the process comprises forming on the tubular or almost tubular film structure transversal seals (8), oriented transversally to a direction of advancement of the film along the operating path, to define the plurality of consecutive plastic bags (2), which are positioned adjacent to each other along said operating path.

In a 74th aspect according to the preceding aspect each of said consecutive plastic bags (2) delimits a respective seat (3) and is in the form of a semi-sealed bag which has at least one opening.

In a 75th aspect according to the preceding aspect the process comprises a step of withdrawing gas from said semi-sealed plastic bags (2) through said opening and then a step of sealingly close the semi-sealed plastic bags to form sealingly closed plastic bags (2).

In a 76th aspect according to any one of aspects from the 67th to the preceding aspect forming the plurality of plastic bags (2) comprises forming a plurality of consecutively interconnected bags.

In a 77th aspect according to the preceding aspect forming a plurality of consecutively interconnected bags comprises first forming semi-sealed interconnected bags and then closing the semi-sealed interconnected bags to form sealingly closed interconnected bags; and wherein the products (P) to be packaged are inserted in the semi-sealed interconnected bags before formation of the closed interconnected bags.

In a 78th aspect according to any one of aspects from the 67th to the preceding aspect the process comprises forming said at least one connecting zone (6; 6*a*, 6*b*) of each plastic bag (2) for sealingly closing semi-sealed plastic bags and form sealingly closed plastic bags.

In a 79th aspect according to any one of aspects from the 67th to the preceding aspect the process comprises forming said at least one connecting zone (6; 6*a*, 6*b*) of each plastic bag (2) for sealingly closing semi-sealed plastic bags and form sealingly closed interconnected plastic bags (2).

In a 80th aspect according to any one of aspects from the 67th to the preceding aspect the process comprises positioning the respective tab (10) in correspondence of an area of the plastic film destined to form said connecting zone (6; 6*a*, 6*b*) of each plastic bag (2) by placing the respective tab (10) between mutually facing wall portions of the plastic film (23) before forming the plastic bags such that each respective tab (10), once the plastic bags are formed, is sandwiched between the inner surfaces of the opposed wall portions (4*a*) of the corresponding plastic bag (2).

In a 81st aspect according to any one of aspects from the 67th to 79th the process comprises positioning the respective tab (10) in correspondence of the connecting zone (6) of each plastic bag (2) by placing the respective tab (10) after having sealingly closed each plastic bag.

In a 82nd aspect according to the 79th aspect the process comprises positioning the respective tab (10) in correspondence of the connecting zone (6) of each plastic bag (2) by placing the respective tab (10) after having sealingly closed each plastic bag and after having separated the interconnected plastic bags (2) from each other.

In an 83rd aspect according to any one of the preceding two aspects each tab (10) is fixed, in particular adhesively or heat bonded, to the outer surface one or both of the opposed wall portions (4*a*) of each plastic bag (2).

In an 84th aspect according to any one of the preceding aspects from the 80th to the 83rd each tab (10) is positioned as a discrete tab in correspondence of:

the connecting zone (6; 6*a*, 6*b*) of a respective plastic bag (2).

In an 85th aspect according to any one of the preceding aspects from the 80th to the 83rd each tab (10) is positioned as a discrete tab in correspondence of:

a respective area of the tubular or almost tubular film structure destined to form the connecting zone (6; 6*a*, 6*b*) of a plastic bag (2).

In an 86th aspect according to any one of the preceding aspects from the 80th to the 83rd each tab (10) is positioned as a discrete tab in correspondence of:

a respective area of the plastic film (23) before being formed into the tubular or almost tubular film structure, said respective area destined to form the connecting zone (6; 6*a*, 6*b*) of a plastic bag (2).

In an 87$^{th}$ aspect according to any one of the preceding aspects from the 80$^{th}$ to the 86$^{th}$ each tab (10) is a portion of a continuous longitudinal strip which is fed along the operating path in synchrony with said plastic film (23), consecutive portions of said continuous strip destined to form respective tabs (10) being positioned in correspondence of the connecting zone (6; 6*a*, 6*b*) of the respective plastic bag (2) or of a respective area of plastic film destined to form the connecting zone (6; 6*a*, 6*b*) of a plastic bag (2).

In an 88$^{th}$ aspect according to any one of aspects from the 65$^{th}$ to the preceding aspect the plastic film (23) is a heat-shrinkable plastic film.

In an 89$^{th}$ aspect according to any one of aspects from the 65$^{th}$ to the preceding aspect the plastic film (23) is a heat-shrinkable plastic film showing a free shrinking value at 120° C. (value measured in accordance with ASTM D2732, in oil) in the range from 2% to 80% in both longitudinal and transverse directions.

In a 90$^{th}$ aspect according to any one of aspects from the 65$^{th}$ to the preceding aspect the plastic film (23) is a heat-shrinkable plastic film showing a free shrinking value at 120° C. (value measured in accordance with ASTM D2732, in oil) in the range from 5% to 60% in both longitudinal and transverse directions.

In a 91$^{st}$ aspect according to any one of aspects from the 65$^{th}$ to the preceding aspect the plastic film (23) is a heat-shrinkable plastic film showing a free shrinking value at 120° C. (value measured in accordance with ASTM D2732, in oil) in the range from 10% to 40% in both longitudinal and transverse directions.

In a 92$^{nd}$ aspect according to any one of aspects from the 65$^{th}$ to the preceding aspect the process includes heat treating the portion of each plastic bag where a/said seat (3) for a respective product (P) is defined to heat shrink said portion of each consecutive bag around the respective product (P).

In a 93$^{rd}$ aspect according to the preceding aspect said step of heat treating the portion of each plastic bag where said seat (3) is defined does not involve heat treating the portion of each plastic bag adjacent to said seat (3) and destined to form said connecting zone (6; 6*a*, 6*b*) to which the tab (10) is coupled which is maintained thermally insulated from any heat source or sources used to heat treat the portion of each plastic bag where said seat (3) is defined, such that the portion of each plastic bag destined to form the connecting zone is not heat shrunk or is heat shrunk significantly less than the portion where said seat (6) is defined.

In a 94$^{th}$ aspect according to any one of the preceding two aspects the step of heat treating takes place before or during step of withdrawing gas from said plastic bags (2) through said opening and before sealingly close the semi-sealed plastic bags (2) and forming sealed bags (2).

In a 95$^{th}$ aspect according to any one of the preceding three aspects said step of heat treating is achieved using hot air, optionally hot air at a temperature comprised between 130° C. and 160° C.

In a 96$^{th}$ aspect according to any one of the preceding four aspects the process comprises a further step of heat treating, which takes place after sealingly closing the plastic bags, in particular interconnected plastic bags (2), and with the tab (10) fixed to the respective connecting zone (6) of each plastic bag (2); said further step of heat treating exclusively heat treating the at least one connecting zone (6; 6*a*, 6*b*) of each bag to heat shrink the same connecting zone (6; 6*a*, 6*b*).

In a 97$^{th}$ aspect according to the preceding aspect said further step of heat treating is achieved using a heated belt acting in contact on the at least one connecting zone (6; 6*a*, 6*b*) of each plastic bag or of each interconnected plastic bag.

In a 98$^{th}$ aspect according to the preceding aspect said further step of heat treating is achieved using a pair of heated belts acting on opposite sides of the connecting zone of each plastic bag or of each interconnected plastic bag.

In a 99$^{th}$ aspect according to the preceding aspect each heated belt has a width (measured perpendicular to the direction of movement of the belt) of at least 10 mm.

In a 100$^{th}$ aspect according to the preceding aspect each heated belt has a width, comprised between 20 and 40 mm.

In a 101$^{st}$ aspect according to any one of the preceding six aspects said further step of heat treating is achieved using hot air.

In a 102$^{nd}$ aspect according to the preceding aspect said further step of heat treating is achieved using hot air at a temperature comprised between 130° C. and 160° C.

In a 103$^{rd}$ aspect according to any one of aspects from the 65$^{th}$ to the preceding aspect the process comprises heat treating the plastic bags (2), or the packages, offline at a dedicated heat treatment station, using hot air and/or hot liquid to treat the entire plastic bag (2) or package.

In a 104$^{th}$ aspect according to any one of aspects from the 65$^{th}$ to the preceding aspect the tab (10) is a made, in particular entirely made, of paper.

In a 105$^{th}$ aspect according to any one of aspects from the 65$^{th}$ to the 103$^{rd}$ the tab (10) is a made, in particular entirely made, of paperboard.

In a 106$^{th}$ aspect according to any one of aspects from the 65$^{th}$ to the 103$^{rd}$ the tab (10) is a made, in particular entirely made of non-heat-shrinkable plastic material In a 107$^{th}$ aspect according to any one of aspects from the 65$^{th}$ to the 103$^{rd}$ the tab (10) is a made, in particular entirely made, of PE.

In a 108$^{th}$ aspect according to any one of aspects from the 65$^{th}$ to the preceding aspect the tab (10) has thickness greater than the thickness of the plastic film.

In a 109$^{th}$ aspect according to any one of aspects from the 65$^{th}$ to the preceding aspect the thickness of the tab (10) is between 35 and 400 μm.

In a 110$^{th}$ aspect according to any one of aspects from the 65$^{th}$ to the preceding aspect the plastic film (23) has thickness comprised between 10 and 60 μm.

In a 111th aspect according to any one of aspects from the 65$^{th}$ to the preceding aspect the plastic film (23) has thickness comprised between 15 and 45 μm.

In a 112$^{th}$ aspect according to any one of aspects from the 65$^{th}$ to the preceding aspect the plastic film (23) has thickness comprised between 20 and 35 μm.

A 113$^{th}$ aspect concerns a process of making packages comprising:

advancing a plastic film (23) along an operating path, wherein the plastic film (23) is a heat-shrinkable plastic film;

forming a plurality of plastic bags (2) from the plastic film (23), each of said plastic bags (2) having a seat (3) hosting a respective product (P);

heat-treating at least a portion of each plastic bag (2) where said seat (3) for a respective product (P) is defined to heat shrink at least said portion of each plastic bag (3);

applying a vacuum to extract gas from said seat (3) via at least one opening in each plastic bag (2), and then sealingly close each plastic bag (2) to form a vacuumized package (1) from each plastic bag.

In a 114$^{th}$ aspect according to the preceding aspect the step of applying a vacuum starts after initiation of said step of heat treating said portion of the plastic bag (2) where said seat (3) is defined.

In a 115$^{th}$ aspect according to any one of the preceding two aspects the step of applying a vacuum starts after initiation of shrinking of said portion of the plastic bag where said seat (3) is defined.

In a 116$^{th}$ aspect according to any one of the preceding three aspects the step of applying a vacuum starts during heat-treating of said portion of the plastic bag where said seat (3) is defined.

In a 117$^{th}$ aspect according to any one of the preceding four aspects the step of applying a vacuum starts during shrinking of said portion of the plastic bag where said seat (3) is defined.

In a 118$^{th}$ aspect according to any one of the preceding five aspects the process provides that, for each plastic bag (2), the step of applying a vacuum to extract gas from said portion of the plastic bag where the seat (3) is defined and the step of heat treating said same portion of the same plastic bag (2) take place together at least during a time period.

In a 119$^{th}$ aspect according to the preceding aspect the process provides that, for each plastic bag (2), the step of applying a vacuum to extract gas from said portion of the plastic bag where the seat (3) is defined and the step of heat treating said same portion of the same plastic bag (2) take place together at least during a time period before the step of sealingly close the plastic bag.

In a 120$^{th}$ aspect according to any one of the preceding two aspects, said time period is comprised between 0.2 and 2 seconds.

In a 121$^{st}$ aspect according to any one of the preceding eight aspects the step of applying a vacuum starts after completion of the step of heat-treating of said portion of the plastic bag where said seat (3) is defined.

In a 122$^{nd}$ aspect according to any one of the preceding nine aspects the step of applying a vacuum starts after having shrunk said portion of the plastic bag where said seat (3) is defined.

In a 123$^{rd}$ aspect according to any one of the preceding ten aspects the step of applying a vacuum lasts until after conclusion of said step of heat-treating of said portion of the plastic bag where said seat (3) is defined.

In a 124$^{th}$ aspect according to any one of the preceding eleven aspects the step of applying a vacuum lasts until after at least 1 second after conclusion of said step of heat-treating of said portion of the plastic bag where said seat (3) is defined.

In a 125$^{th}$ aspect according to any one of the preceding twelve aspects the step of applying a vacuum lasts until after 2 seconds after conclusion of said step of heat-treating of said portion of the plastic bag where said seat (3) is defined.

In a 126$^{th}$ aspect according to any one of the preceding thirteen aspects the step of applying a vacuum lasts until after conclusion of said shrinking of said portion of the plastic bag where said seat (3) is defined.

In a 127$^{th}$ aspect according to any one of the preceding fourteen aspects the step of applying a vacuum lasts until after at least 1 second after conclusion said shrinking of said portion of the plastic bag where said seat (3) is defined.

In a 128$^{th}$ aspect according to any one of the preceding fifteen aspects the step of applying a vacuum lasts until after 2 seconds after conclusion of said shrinking of said portion of the plastic bag where said seat (3) is defined.

In 129$^{th}$ aspect according to any one of the preceding sixteen aspects the step of applying a vacuum is obtained by applying a vacuum at the at least one opening which determines a suction of gas through said at least one opening of each plastic bag (2).

In 130$^{th}$ aspect according to any one of the preceding seventeen aspects the plastic film (23) is made of a heat-shrinkable plastic film showing a free shrinking value at 120° C. (value measured in accordance with ASTM D2732, in oil) in the range from 2% to 80% in both longitudinal and transverse directions.

In 131$^{st}$ aspect according to any one of the preceding eighteen aspects the plastic film (23) is made of a heat-shrinkable plastic film showing a free shrinking value at 120° C. (value measured in accordance with ASTM D2732, in oil) in the range from 50% to 70% in both longitudinal and transverse directions.

In 132$^{nd}$ aspect according to any one of the preceding nineteen aspects the plastic film (23) is made of a heat-shrinkable plastic film showing a free shrinking value at 120° C. (value measured in accordance with ASTM D2732, in oil) in the range from 10% to 40% in both longitudinal and transverse directions.

In 133$^{rd}$ aspect according to any one of the preceding twenty aspects the products (P) to be packaged are advanced along the operating path together with the plastic film (23), the plastic film (23) being positioned around the products (P) before formation of the plastic bags.

In 134$^{th}$ aspect according to any one of the preceding twenty-one aspects forming the plurality of plastic bags comprises:

forming a plurality of consecutive semi-sealed bags each one having said at least one opening, and then closing the semi-sealed bags to form sealingly closed bags, wherein the products (P) to be packaged are inserted in the semi-sealed bags obtained before formation of the closed bags.

In 135$^{th}$ aspect according to any one of the preceding twenty-two aspects the operating path is horizontal or vertical.

In 136$^{th}$ aspect according to any one of the preceding twenty-three aspects together with said step of applying a vacuum the process provides for applying an external compressive pressure, optionally by means of a mechanical presser (such as a foam cushion), at least to the portion of the bag defining said seat (3) in order to further promote evacuation of gas through said at least one opening of each bag (29).

In 137$^{th}$ aspect according to any one of the preceding twenty-four aspects the plastic film (23) is a continuous plastic film, optionally unrolled from a feed roll (24), which is shaped into a tubular or in an almost tubular film structure receiving the products (P).

In a 138$^{th}$ aspect according to the preceding aspect the process comprises forming on the tubular or almost tubular film structure transversal seals (8), oriented transversally to a direction of advancement of the film along the operating path, to define the/a plurality of adjacent plastic bags (2) (which may be disconnected adjacent bags or interconnected bags), which are positioned one next to the other along said operating path.

In a 139$^{th}$ aspect according to the preceding aspect said plurality of adjacent bags are formed as semi-sealed plastic bag, each delimiting a respective seat (3) and having at least one opening, and wherein the step of extracting gas from said semi-sealed plastic bags (2) withdraws gas through said opening and then the step of sealingly close the semi-sealed plastic bags to form sealed plastic bags (2) takes place.

In a 140$^{th}$ aspect according to any one of the preceding two aspects the process includes forming at least one connecting zone (6; 6*a*, 6*b*) of each plastic bag (2) for sealingly closing the semi-sealed plastic bags.

In a 141$^{st}$ aspect according to any one of aspects from the 113$^{rd}$ to the preceding aspects wherein said step of heat treating is achieved using hot air.

In a 142$^{nd}$ aspect according to the preceding aspect wherein said step of heat treating is achieved by using hot air at a temperature comprised between 130° C. and 160° C., in particular wherein said hot air is blown at least towards said portion of the plastic bag where said seat (3) is defined.

In a 143$^{rd}$ aspect according to any one of aspects from the 113$^{rd}$ to the preceding aspect the steps of forming a plurality of plastic bags (2) from the plastic film (23), each of said plastic bags (2) having a seat (3) hosting a respective product (P);

heat-treating at least a portion of each plastic bag (2) where said seat (3) for a respective product (P) is defined to heat shrink at least said portion of each plastic bag (3), are consecutive steps with heat treating being executed after the step of forming the plurality of plastic bags.

A 144$^{th}$ aspect concerns a process of making packages comprising:

advancing a plastic film (23) along an operating path, wherein the plastic film (23) is a heat-shrinkable plastic film;

heat-treating at least a portion of the plastic film where a seat (3) for a product is about to be defined to heat shrink at least said portion of the plastic film;

forming a plurality of plastic bags (2) from the plastic film (23), each of said plastic bags (2) having a respective seat (3) hosting a respective product (P);

applying a vacuum to extract gas from said seat (3) via at least one opening in each plastic bag (2), and then sealingly close each plastic bag (2) to form a vacuumized package (1) from each plastic bag.

In a 145$^{th}$ aspect according to the preceding aspect the steps heat-treating at least a portion of the plastic film where a seat (3) for a product is about to be defined to heat shrink at least said portion of the plastic film;

forming a plurality of plastic bags (2) from the plastic film (23), each of said plastic bags (2) having a respective seat (3) hosting a respective product (P);

are consecutive steps with the step of forming the plurality of plastic bags being executed during or after the step of heat treating.

In a 146$^{th}$ aspect according to any one of the preceding two aspects the step of applying a vacuum starts after initiation of said step of heat treating said portion of the plastic film and/or the step of applying a vacuum starts after initiation of shrinking of said portion of the plastic film.

In 147$^{th}$ aspect according to any one of the preceding three aspects the step of applying a vacuum is obtained by applying a vacuum at the at least one opening which determines a suction of gas through said at least one opening of each plastic bag (2).

In 148$^{th}$ aspect according to any one of the preceding four aspects the plastic film (23) is made of a heat-shrinkable plastic film showing a free shrinking value at 120° C. (value measured in accordance with ASTM D2732, in oil) in the range from 2% to 80% in both longitudinal and transverse directions.

In 149$^{th}$ aspect according to any one of the preceding five aspects the plastic film (23) is made of a heat-shrinkable plastic film showing a free shrinking value at 120° C. (value measured in accordance with ASTM D2732, in oil) in the range from 50% to 70% in both longitudinal and transverse directions.

In 150$^{th}$ aspect according to any one of the preceding six aspects the plastic film (23) is made of a heat-shrinkable plastic film showing a free shrinking value at 120° C. (value measured in accordance with ASTM D2732, in oil) in the range from 10% to 40% in both longitudinal and transverse directions.

In 151$^{st}$ aspect according to any one of the preceding seven aspects the products (P) to be packaged are advanced along the operating path together with the plastic film (23), the plastic film (23) being positioned around the products (P) before formation of the plastic bags.

In 152$^{nd}$ aspect according to any one of the preceding eight aspects forming the plurality of plastic bags comprises:

forming a plurality of consecutive semi-sealed bags each one having said at least one opening, and then closing the semi-sealed bags to form sealingly closed bags, wherein the products (P) to be packaged are inserted in the semi-sealed bags obtained before formation of the closed bags.

In 153$^{rd}$ aspect according to any one of the preceding nine aspects the operating path is horizontal or vertical.

In 154$^{th}$ aspect according to any one of the preceding ten aspects together with said step of applying a vacuum the process provides for applying an external compressive pressure, optionally by means of a mechanical presser (such as a foam cushion), at least to the portion of the bag defining said seat (3) in order to further promote evacuation of gas through said at least one opening of each bag (29).

In 155$^{th}$ aspect according to any one of the preceding eleven aspects the plastic film (23) is a continuous plastic film, optionally unrolled from a feed roll (24), which is shaped into a tubular or in an almost tubular film structure receiving the products (P).

In a 156$^{th}$ aspect according to the preceding aspect the process comprises forming on the tubular or almost tubular film structure transversal seals (8), oriented transversally to a direction of advancement of the film along the operating path, to define the/a plurality of adjacent plastic bags (2) (which may be disconnected adjacent bags or interconnected bags), which are positioned one next to the other along said operating path.

In a 157$^{th}$ aspect according to the preceding aspect said plurality of adjacent bags are formed as semi-sealed plastic bag, each delimiting a respective seat (3) and having at least one opening, and wherein the step of extracting gas from said semi-sealed plastic bags (2) withdraws gas through said opening and then the step of sealingly close the semi-sealed plastic bags to form sealed plastic bags (2) takes place.

In a 158$^{th}$ aspect according to any one of the preceding two aspects the process includes forming at least one connecting zone (6; 6*a*, 6*b*) of each plastic bag (2) for sealingly closing the semi-sealed plastic bags.

In a 159$^{th}$ aspect according to any one of aspects from the 113$^{th}$ to the preceding aspects wherein said step of heat treating is achieved using hot air.

In a 160$^{th}$ aspect according to the preceding aspect wherein said step of heat treating is achieved by using hot air at a temperature comprised between 130° C. and 160° C., in particular wherein said hot air is blown at least towards said portion of the plastic bag where said seat (3) is defined.

In a 161$^{st}$ aspect according to any one of aspects from the 113$^{th}$ to the preceding aspect the process comprises further heat treating the plastic bags (2), or the packages obtained from said bags, offline at a dedicated heat treatment station, using hot air and/or hot liquid to treat the entire plastic bag (2) or package.

In a $162^{nd}$ aspect according to any one of aspects from the $113^{th}$ to the preceding aspect the plastic film (23) has thickness comprised between 10 and 60 μm, optionally between 15 and 45 μm, more optionally between 20 and 35 μm.

In a $163^{rd}$ aspect according to any one of aspects from the $113^{th}$ to the preceding aspect the process is used for making the package of any one of aspects from the $1^{st}$ to $112^{th}$.

In a $164^{th}$ aspect according to any one of the preceding aspects the plastic bag (2) is formed by two separate sheets (instead of one sheet bent along zone/line 7): in this case instead of bend zone (7), there would be a further sealing band, with the rest of the features of the packages 1 described in the above aspects remaining unchanged.

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 1 is a front view of a package according to the present invention;

FIG. 2 is a cross section according to transverse section plane II-II of FIG. 1;

FIG. 3 is a cross section according to transverse section plane III-III of FIG. 1;

FIG. 4 is a cross section according to longitudinal section plane IV-IV of FIG. 1;

FIG. 5 is a perspective view of the package of FIG. 1;

FIG. 6 is a front view of a package according to a variant of the present invention;

FIG. 7 is a cross section according to transverse section plane VII-VII of FIG. 6;

FIG. 8 is a cross section according to transverse section plane VIII-VIII of FIG. 6;

FIG. 9 is a cross section according to longitudinal section plane IX-IX of FIG. 6;

FIG. 10 is a perspective view of the package of FIG. 6;

CONVENTIONS

Figure 11A:
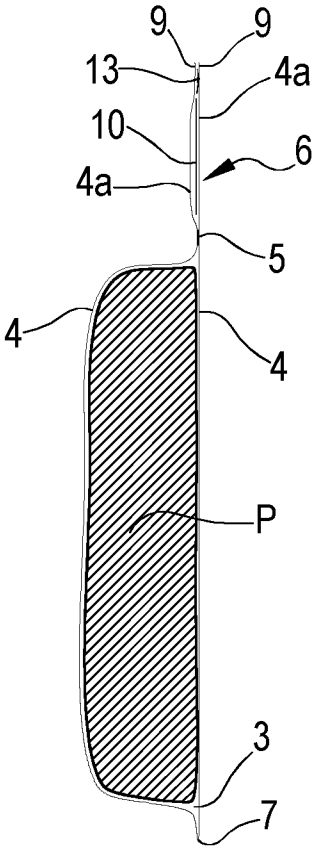
FIGS. 11A, 12A, 13A, 14A, 15A, 16A, 17A, 18A, 19A, 20A, 21A, 22A, 23A and 28A are longitudinal cross sections of the packages respectively shown in FIGS. 11, 12, 13, 14, 15, 16, 17, 18, 19, 20, 21, 22, 23 and 28.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a product to be packaged along a predetermined operating path in the respective production line.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described herein includes at least one control unit designed to perform the steps of the process for making the package. The control unit can clearly be only one or be formed by a plurality of different control units according to the design choices and the operational needs. The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

The Film

The film used for forming the bags and packages of the invention is made of plastic material, in particular polymeric material; the film is for example a flexible mono or multilayer material comprising at least an outer heat-weldable layer. In case of a multilayer film, the film may include an optional gas barrier layer and a one or more protective layers.

The film, in a currently preferred option, is a heat-shrinkable plastic film showing a free shrinking value at 120° C. (value measured in accordance with ASTM D2732, in oil) in the range from 2% to 80%, optionally from 5% to 60%, in particular from 10% to 40%, in both longitudinal and transverse directions. As used herein the terminology "heat-shrinkable," "heat-shrink," and the like, refer to the tendency of film to shrink upon the application of heat, such that the size of the film decreases while the film is in an unrestrained state.

The plastic film material has preferably thickness comprised between 10 and 60 μm, optionally between 15 and 45 μm. In one example, the plastic film material has thickness comprised between 20 and 35 μm and is heat-shrinkable showing the free shrinking value indicated above.

Although, any plastic film with the above thickness, optionally made in shrinkable material with the above shrink properties would be adequate to implement the claimed invention, suitable exemplifying materials are disclosed in the following publications, which are herein incorporated by reference: EP2477813, EP2805821, EP1140493, EP987103, EP881966, EP801096.

The Tab

The tab applied to the plastic bags to form the packages of the invention is made, in particular entirely made, of paper, or paperboard, or PE or non-heat-shrinkable plastic material. In particular the tab is a thin strip, for example a thin rectangular strip.

The tab has thickness greater than the thickness of the plastic film material forming the plastic bag. In particular, the thickness of the tab is between 35 and 400 μm.

The Sealing Bands

The sealing bands are preferably obtained by heat bonding or by gluing and may be either continuous sealing bands extending continuously and without interruption across a width or a length (entire width or entire length) of the plastic bag or discontinuous sealing bands comprising, along their extension, sealing zones intercalated by non-sealing zones.

DETAILED DESCRIPTION

Package 1

In FIGS. 1-5 is shown a first embodiment of a package 1 according to aspects of the invention. The package 1 comprises a plastic bag 2, which delimits a seat 3 sealingly housing a product P: for example a food product P or a product of other nature.

The plastic bag 2 has plastic film walls 4: in the example shown, the plastic bag has two opposite plastic film walls 4. A sealing band 5 connects together opposed wall portions 4*a* of the plastic film walls 4; a connecting zone 6 is thereby formed comprising the mentioned sealing band 5 and connecting together opposed mutually facing wall portions 4*a* of the plastic film walls 4 of the plastic bag: in the example shown, the connecting zone 6 is at a top region of the bag 2.

Going into greater detail, the plastic bag shown in FIGS. 1-5 is for example made from a single plastic foil (i.e. a single piece of plastic in sheet form, which may have monolayer or a multilayer structure) and the connecting zone 6 of the plastic bag is formed by mutually facing ends of the opposed film wall portions 4*a* of the same single plastic film, by the sealing band 5 and by one or more further sealing bands as hereinafter explained.

In practice, the plastic bag 2 of FIGS. 1-5 is formed by bending a single plastic foil at a bend zone 7, which in the specific example takes the shape of a fold line, to form the two opposing film walls 4, which are joined together at the mentioned bend zone or fold line 7 and at the connecting zone 6 by the sealing band 5; the two opposing film walls 4 are also joined together, at side edges thereof, by transverse sealing bands 8 extending from the fold line 7 to the sealing band 5, in order to hermetically close the product into the seat 3 which is basically delimited by the transverse sealing bands 8 (at both sides of the bag), by the sealing band 5 (at the top region of the bag 2) and by the fold line 7 (at the bottom region of the bag 2). As it can be seen from FIGS. 1 and 5, the bend zone 7 forms two mutually facing plastic film walls 4 having first ends connected at the bend zone 7 and second ends, opposed to the first ends and distal with respect to the bend zone 7: the product P located in a volume V positioned between the first ends and the said second ends of the mutually facing plastic film walls.

In the example shown in FIGS. 1-5, the sealing band 5 extends adjacent and parallel to a peripheral border 9 (top border in the figures, which also defines the top border of the bag 2 and which may be basically coincident with the top border of the sealing band) of the mutually facing ends of the opposed film walls 4, and the easy opening feature is oriented transversally to the sealing band 5. The sealing band 5 shown in the example is basically a straight band, but nothing excludes that the sealing band may be undulated or has non straight shape as long as it extends transversally to the transverse sealing bands 8 all the way from one sealing band 8 to the opposite sealing band 8 in a way to gas tightly close the seat 3.

In accordance with one aspect of the invention, a tab 10 is coupled with the connecting zone 6 of the plastic bag 2. In detail, the tab 10 is fixed to the connecting zone of the bag 2 is a way to intimately adhere to the same connecting zone, such that the tab maintains substantial planarity and smoothness of the plastic material forming the connecting zone. As shown in the figures, the tab 10 includes an easy opening feature 11 located at one of its perimeter edges 12: in particular, the easy opening feature is a notch (i.e., a cutout or an indent through the thickness of the tab creating a discontinuity in the tab perimeter) or a weakening line (i.e., formed by a localized reduction of thickness or by a sequence of holes or short cuts positioned to form a line of weakness in the tab material departing from the tab perimeter) or a cut (i.e. a cut line through the thickness of the tab with no removal of tab material leaving opposed borders of the cut itself in contact the one with the other); the notch or cut or weakening line extends from the top perimeter 12 of the tab across a portion of the tab: for example in case of a substantially rectangular tab, the notch or weakening line may extend across at least 25% of the minor dimension of the tab. As shown in the drawings, the notch or wakening line 11 is oriented towards the seat 3 and is oriented transversally to the sealing band 5, such that acting on the tab will cause a propagation of line of fracture on the tab directed transversally to the same sealing band 5.

With particular reference to FIGS. 1, 2 and 4, the connecting zone 6 of the plastic bag 2 is formed by mutually facing ends of the opposed walls 4 forming a sort of pocket where the tab 10 is inserted and blocked. In detail, the tab 10 is coupled with the connecting zone of the plastic bag such that each one of the tab opposed prevalent surfaces intimately adheres to a respective one of the inner surfaces of the opposed wall portions 4*a* (see FIGS. 2 and 4). In other words, the tab is sandwiched between the inner surfaces of the opposed wall portions 4*a* of the plastic bag 2. Furthermore, in order to keep the tab 10 in position, the connecting zone 6 comprises, in addition to said sealing band 5 (which may be regarded as a first sealing band), also a second sealing band 13 positioned at a distance from the first sealing band 5: the tab 10 is positioned in the pocket between the first sealing band and the second sealing band. At least one of said first sealing band and second sealing band 5, 13 (preferably the first sealing band) is designed to guarantee gas tight sealing of the seat 3 from an environment external to plastic bag and is therefore a continuous sealing band extending across a width of the plastic bag and connecting the two transverse sealing bands 8. The other of said first and second sealing bands 5, 13 (preferably the second sealing band) may be either similar to the first sealing band or a discontinuous sealing band comprising sealing zones intercalated by non-sealing zones. As mentioned, in the example of FIGS. 1-5, the tab 10 is substantially rectangular and the first and second sealing bands 5, 13 are parallel and at a distance to each other sufficient to define a pocket sized to receive the tab.

Again with reference to the exemplifying drawings of FIGS. 1 and 5, the sealing bands 5 and 13 are elongated and in particular present a length in a direction of prevalent development, preferably parallel to a tab top edge, and a width measured perpendicular to the direction of prevalent development which is significantly smaller than the length: in the exemplifying drawings the width of the sealing band may be from 0.5 mm to 10 mm, while the length of each sealing band may significantly greater such as from 50 to 200 or even more mm.

In accordance with a further aspect the plastic bag 2 is a vacuumized bag: consequently the inner surfaces of the opposite wall portions 4*a* adhere to the product and also may adhere to each other in certain parts of the seat 3 not occupied by the product.

It is also to be noted that in another aspect which characterizes the bag of the enclosed FIGS. 1-5 the bag is made of a heat-shrinkable plastic film showing a free shrinking value at 120° C. (value measured in accordance with ASTM D2732, in oil) in the range from 2% to 80%, optionally from 5% to 60%, in particular from 10% to 40%, in both longitudinal and transverse directions. In particular, the connecting zone of the bag, in the final package, is made of heat-shrinkable material which has been heat shrunk such that, on the one hand, the plastic film material intimately adheres to the tab surfaces and, on the other hand, the tab keeps the plastic material flat and smooth (with thus enhanced aesthetical properties including enhanced clarity), and with the easy opening feature 11 being able, when operated to trigger formation of a rupture in the tab, to also trigger a corresponding rupture propagation in the film material forming the connecting zone thus facilitating opening of the bag 2.

In this respect, it is noted that the tab is a body distinct from the bag and more rigid than the plastic film forming the bag: for example the tab is a made, in particular entirely made, of paper, or paperboard, or PE or other non-heat-shrinkable plastic material and has thickness greater than the thickness of the plastic film material forming the plastic bag. For example, the thickness of the tab is between 35 and 400 μm, while the thickness of the plastic film material of the bag 2 is comprised between 10 and 60 μm, optionally between 15 and 45 μm, more optionally between 20 and 35 μm.

Going now into the geometric details of the tab, the tab 10 comprises a first and second flap 10*a* and 10*b*, adjacent to each other: the easy opening feature 11, in particular said notch, cut or said weakening line, extends from a tab edge 12 in correspondence of a tab intermediate region 10*c* between the first and second flaps 10*a* and 10*b*. The first and second flaps are operable by a user and may move from a substantially coplanar condition to an angularly offset and/or teared apart condition (basically the two flaps may be separated by either pulling the two flaps apart and/or by tilting the two flaps): as the user moves the first and second flaps apart from each other, this causes propagation of a fracture line from the easy opening feature across the tab and, subsequently, determines formation of a rupture across the plastic bag connecting zone.

As shown in dashed lines in FIGS. 1-5, the bag 2 may comprise an optional further easy opening feature 14, in particular a further notch, cut or a further weakening line, formed in the plastic material of the bag and extending from peripheral border 9 of the walls 4 and of plastic bag 2, adjacent to the connecting zone 6 of the bag or partly crossing the connecting zone 6. The optional further notch, cut or further weakening line 14 is oriented towards said seat 3: in accordance with a further aspect, the further notch, cut or further weakening line 14 is aligned with the notch, cut or weakening line 11 present in the tab, and may further facilitate easy opening of the plastic bag 2 at the connecting zone 6. As it is visible from FIG. 1, the further notch, cut or further weakening line 14 may extend from the peripheral border 9 and transversally cross part or the entirety of the second sealing band 13.

In FIGS. 6-10 a second embodiment of a package 1 according to other aspects of the invention is shown. The package 1 of FIGS. 6-10 has most of its features in common with the package of FIGS. 1-5 described above: thus, to avoid repetitions, only the differences between the two embodiments will be now discussed; in FIGS. 6-10, the same reference numerals used in FIGS. 1-5 will be adopted to identify features corresponding to those of FIGS. 1-5 embodiment.

Differently from the package of FIGS. 1-5, the second embodiment shown in FIGS. 6-10 has the tab 10 coupled to an external surface of the bag 2 and in particular to an outer surface of the connecting zone 6.

For example, FIGS. 6-10 show a single tab element which is intimately bonded (e.g., heat bonded or adhesively bonded) to the outside of the plastic bag connecting zone 6, such that one of the tab prevalent surfaces entirely and intimately adheres to the outer surface of one the opposed wall portions 4*a* of the plastic bag 2. Note that it is possible to foresee a tab active on two opposed wall portions 4*a*: in this case the tab would have one prevalent surface having a portion that intimately adheres to the outer surface of one of the opposed wall portions and a consecutive portion that adheres to the outer surface of the other of the opposed wall portions (in practice the tab could in this case be formed by a single element folded the top peripheral border 9 of the bag, and adhesively or heat bonded to the opposed wall portions). In both the above cases, the easy opening features would extend from a perimeter edge of the/each tab 10 and be oriented towards the seat 3. In a further option, two distinct tab elements could be envisaged, each tab element adhering to the outer surface of one respective wall portions (e.g., by adhesive or heat bonding), with a respective easy opening feature, in particular notch or weakening line, extending from the top edge of the tab and directed towards the seat 3.

A further difference of the second embodiment shown in FIGS. 6-10 is that the connecting zone 6 has one single sealing band 5, which is configured to gas tightly seal the seat 3 from an environment external to plastic bag. The example of FIGS. 6-10 has therefore a single tab element adhering above the outer surface of one film wall portion 4*a* and specifically above the single sealing band 5, with the easy opening feature 11 (notch, cut or weakening line) extending from a top edge 12 of the single tab element. As already mentioned, according to a variant, two separate tab elements may be envisaged each adhering to the outer surface of the respective film wall portion 4*a* and specifically to the outer surface of the connecting zone 6: each separate tab element would have a respective easy opening feature, in particular notch, cut or weakening line, extending from a top edge of each tab element and directed towards the seat 3. A further alternative, may use two tab elements connected at a folding line of the tab: each tab element in this case adheres to the outer surface of the respective film wall portion, above the single sealing band 5, with a respective easy opening feature, in particular notch or weakening line, extending from the folding line of the tab.

A further peculiar aspect of the second embodiment of FIGS. 6-10 is that the single sealing band 5 is relatively large, while still having a length in a direction of prevalent development, preferably parallel to a tab top edge; in particular, and the band 5 of the example of FIGS. 6-10 has a width measured perpendicular to the direction of prevalent development which is significantly smaller than the length: in the second embodiment the easy opening feature present in the tab, in particular the notch or weakening line, extends above at least 25%, or at least 50%, of the width of the sealing band 5.

As shown in dashed lines in FIG. 6, the bag 2 may comprise an optional further easy opening feature 14, in particular a further notch, cut or a further weakening line, formed in the plastic material of the bag and extending from peripheral border 9 of the walls 4 and of plastic bag 2, adjacent to the connecting zone 6 of the bag or partly crossing the connecting zone 6. The optional further notch, cut or further weakening line 14 is oriented towards said seat 3: in accordance with a further aspect, the further notch, cut or further weakening line 14 is aligned with the notch, cut or weakening line 11 present in the tab, and may further facilitate easy opening of the plastic bag 2 at the connecting zone 6. As it is visible from FIG. 6, the further notch, cut or further weakening line 14 may extend from the peripheral border 9 and transversally cross part the sealing band 5.

Figure 11:
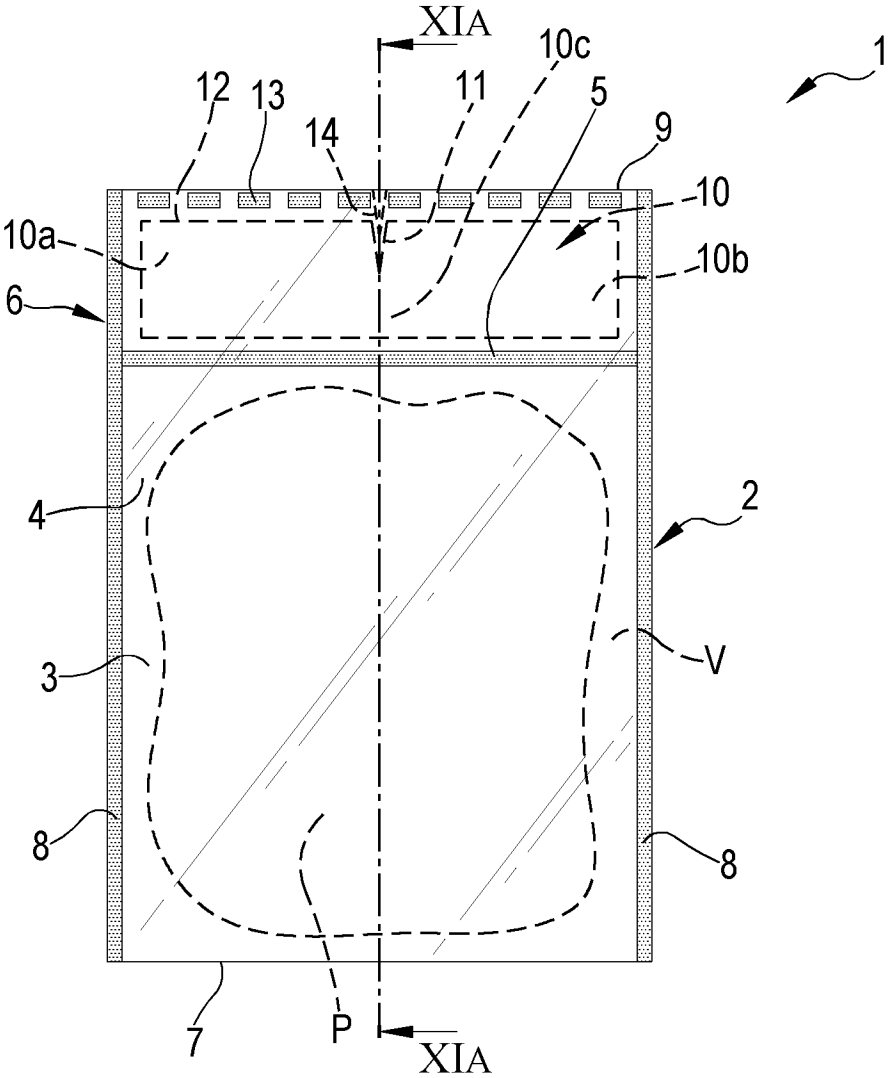
FIGS. 11, 12, 13, 14, 15, 16, 17, 18, 19, 20, 21, 22, 23 and 28 show front views of further embodiments of a package 1 according to other aspects of the invention.

In FIGS. 11, 11A a third embodiment of a package 1 according to other aspects of the invention is shown. The package 1 of FIGS. 11, 11A has the same features of the package of FIGS. 1-5 described above, with the exception of one of the first or second sealing bands, in particular the second sealing band 13, which is a discontinuous sealing band comprises sealing zones (for example in the form of short segments) intercalated by non-sealing zones: the discontinuous second sealing band 13 may extend parallel to the top border 9 from the left to the right transverse sealing band 8. As the remaining features of the embodiment of FIGS. 11, 11A correspond to those of the first embodiment of FIGS. 1-5, the same reference numerals used in FIGS. 1-5 are adopted and the description thereof is not repeated.

Figure 12A:
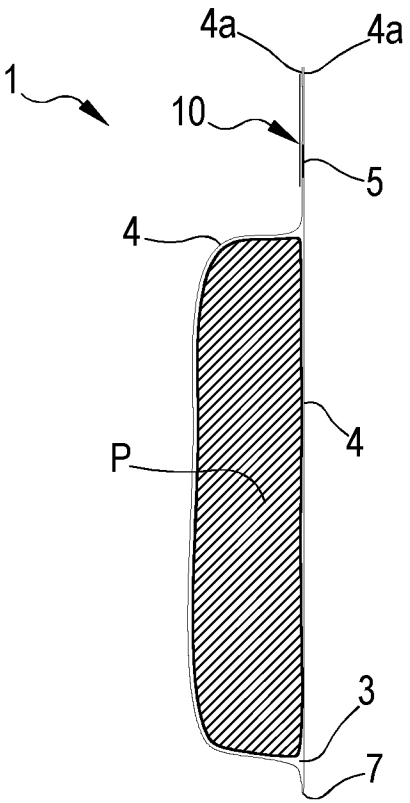
Figure 12:
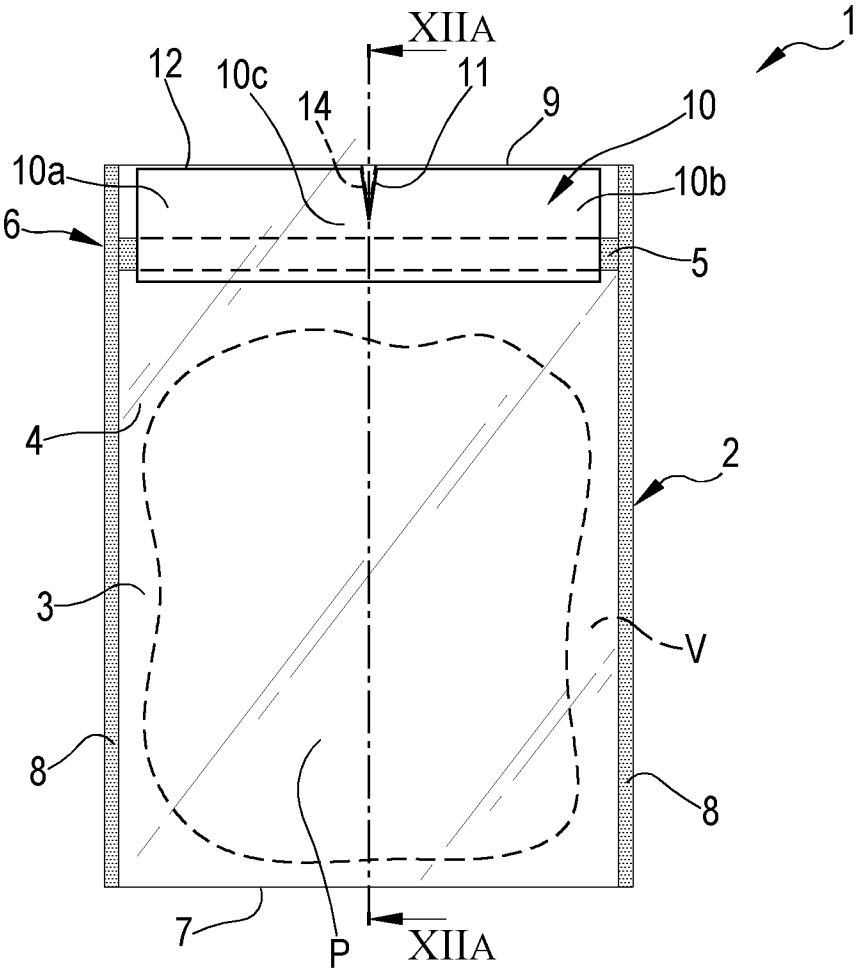

In FIGS. 12, 12A a fourth embodiment of a package 1 according to other aspects of the invention is shown. The package 1 of FIGS. 12, 12A has the same features of the package of FIGS. 6-10 described above, with the exception that the single sealing band 5 is narrower compared to FIG. 6 and narrower compared to the tab 10: in practice the tab 10 has a length in a direction of prevalent development, preferably parallel to a tab top edge, and has a width measured perpendicular to the direction of prevalent development which is significantly smaller than the length, but larger than the width of the single sealing band 5. In this case, the package may include an optional further easy opening feature 14, in particular a further notch, cut or a further weakening line, formed in the plastic material of the bag and extending from peripheral border 9 of the walls 4 and of plastic bag 2. The optional further notch, cut or further weakening line 14 is oriented towards said seat 3: in accordance with a further aspect, the further notch, cut or further weakening line 14 is aligned with the notch, cut or weakening line 11 present in the tab, and may further facilitate easy opening of the plastic bag 2 at the connecting zone 6. As it is visible from FIG. 6, the further notch, cut or further weakening line 14 may extend from the peripheral border 9 but not reach the sealing band 5. Alternatively, the notch, cut or weakening line may partly cross the sealing band 5.

As the remaining features of the embodiment of FIGS. 12, 12A correspond to those of the second embodiment of FIGS. 6-10, the same reference numerals used in FIGS. 6-10 are adopted and the description thereof is not repeated.

Figure 13A:
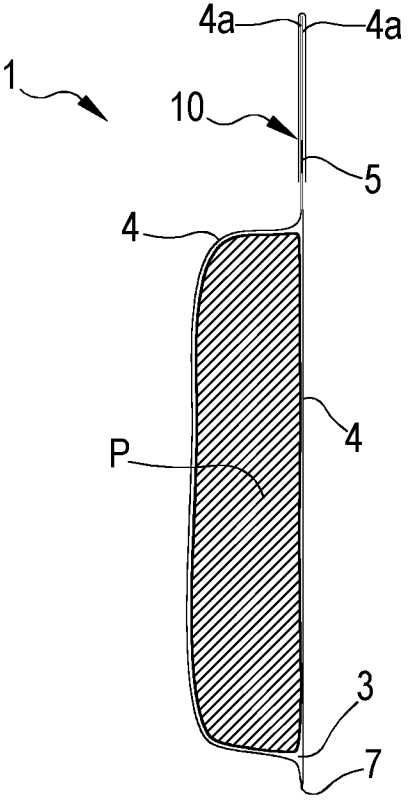
Figure 13:
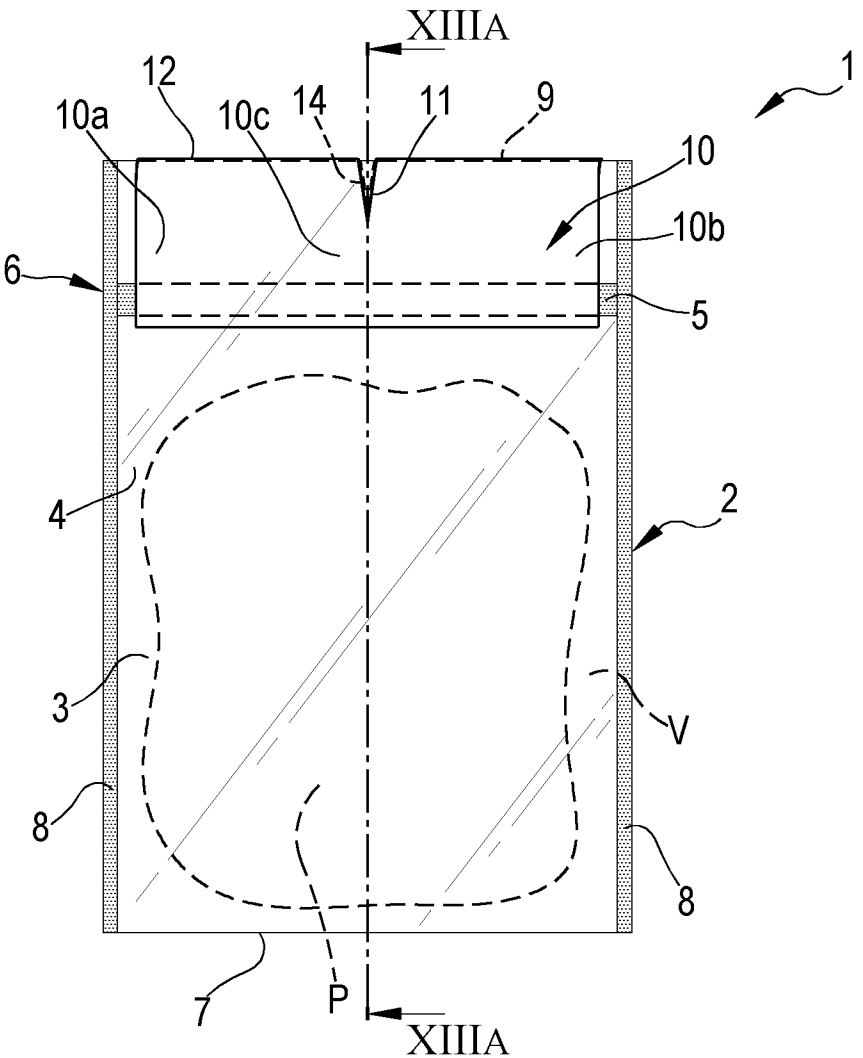

In FIGS. 13, 13A a fifth embodiment of a package 1 according to other aspects of the invention is shown. The package 1 of FIGS. 13, 13A has the same features of the package of FIGS. 6-10 described above, with the exception that the single sealing band 5 is narrower compared to FIG. 6 and narrower compared to the tab 10: in practice the tab 10 has a length in a direction of prevalent development, preferably parallel to a tab top edge, and has a width measured perpendicular to the direction of prevalent development which is significantly smaller than the length, but larger than the width of the single sealing band 5. Moreover, the tab 10 is active on two opposed wall portions 4*a* and has one prevalent surface having a portion that intimately adheres to the outer surface of one of the opposed wall portions and a consecutive portion that adheres to the outer surface of the other of the opposed wall portions: in practice the tab 10 is formed by a single element folded around the bag peripheral border 9, in particular around the top peripheral border 9 of the bag, and adhesively or heat bonded to the opposed wall portions 4*a*. Furthermore, the easy opening feature on the tab 10 may be a notch, cut or weakening line on both opposed portions of the folded tab and thus extend from the tab folding line (parallel to the peripheral border of the bag 2) towards the seat 3.

In this case, the package may include an optional further easy opening feature 14, in particular a further notch, cut or a further weakening line, formed in the plastic material of the bag and extending from peripheral border 9 of the walls 4 and of plastic bag 2. The optional further notch, cut or further weakening line 14 is oriented towards said seat 3: in accordance with a further aspect, the further notch, cut or further weakening line 14 is aligned with the notch, cut or weakening line 11 present in the tab, and may further facilitate easy opening of the plastic bag 2 at the connecting zone 6. As it is visible from FIG. 6, the further notch, cut or further weakening line 14 may extend from the peripheral border 9 but not reach the sealing band 5. Alternatively, the notch, cut or weakening line may partly cross the sealing band 5.

As the remaining features of the embodiment of FIGS. 13, 13A correspond to those of the second embodiment of FIGS. 6-10, the same reference numerals used in FIGS. 6-10 are adopted and the description thereof is not repeated.

Figure 28A:
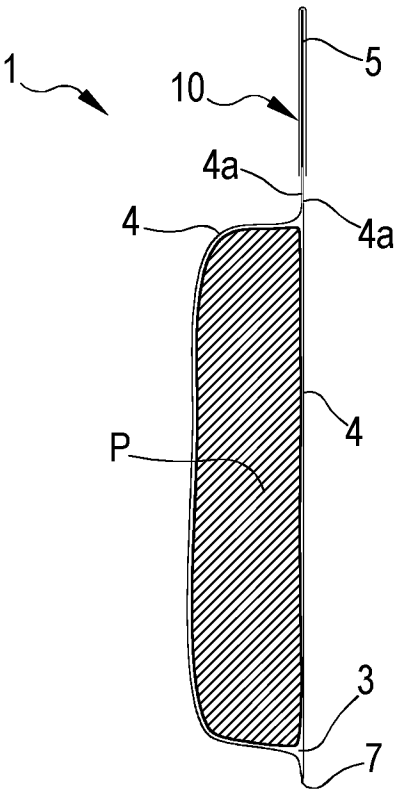
Figure 28:
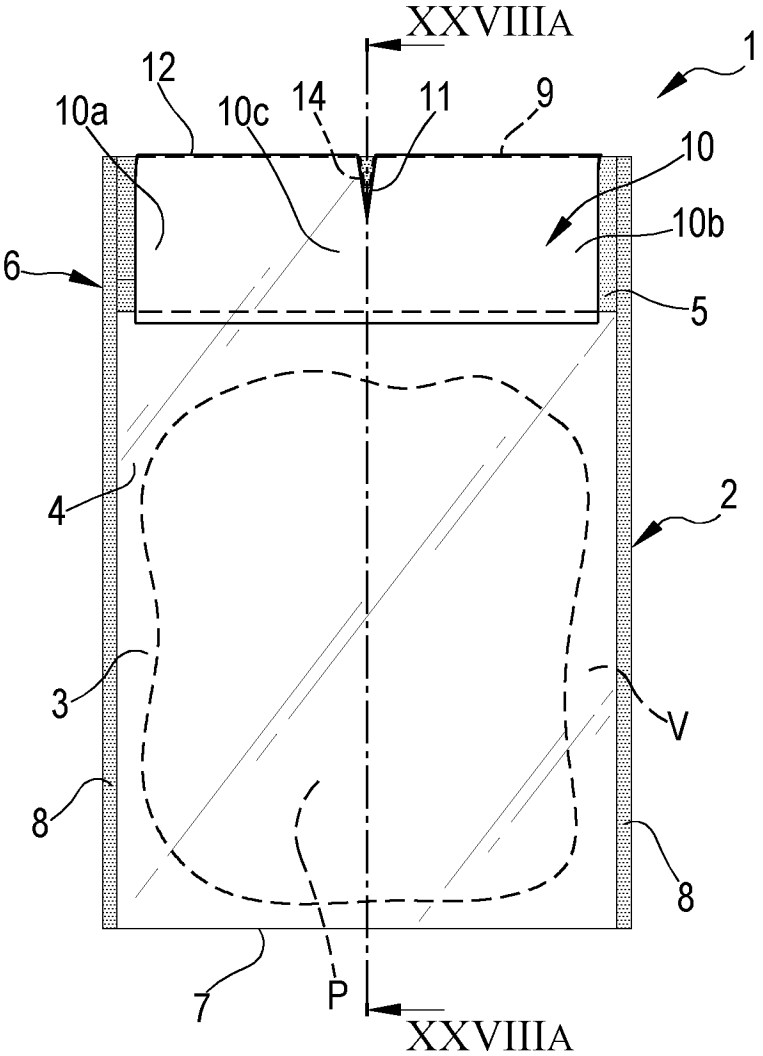

The embodiment of FIGS. 28, 28A is identical to that of FIGS. 6-10 with the exception that in this example the tab is active on the two opposed wall portions 4*a* (in this respect similar to FIGS. 13, 13A embodiment). In the case of FIGS. 28, 28A the tab has one prevalent surface that has a portion that intimately adheres to the outer surface of one of the opposed wall portions and a consecutive portion that adheres to the outer surface of the other of the opposed wall portions (in practice the tab could in this case be formed by a single element folded around the top peripheral border 9 of the bag, and adhesively or heat bonded to the opposed wall portions).

Apart from the peculiarities described above, the remaining features of the embodiment of FIGS. 28-28A correspond to those of the second embodiment of FIGS. 6-10 and thus are not repeated and same reference numbers are used to identify corresponding features.

FIGS. 14-18, 14A-18A schematically show further embodiments, which represent additional variants of the package of FIGS. 1-5 (tab 10 applied internally between walls 4). In practice, in the embodiments of FIGS. 14-18, 14A-18A the tab 10 is again inserted between mutually facing wall portions 4*a* (similar to FIGS. 1-5), but in correspondence of a zone of the bag 2 close to the bend zone or line 7. In these variants the bag has a first connecting zone 6*a* including mutually facing wall portions 4*a* of the first ends of the plastic film walls 4 (i.e. the ends of the film walls proximal or adjacent to the bend zone 7). At least one sealing band extends at a distance from bend zone 7, optionally in a direction parallel to the same bend zone 7.

In the variants of FIGS. 14-18, 14A-18A it is provided a second connecting zone 6*b* (in a position opposite to the bend zone 7) including mutually facing wall portions of second ends of the plastic walls 4: at the second connecting zone 6*b* a respective further sealing band 5*b* is provided which extends across the width of the plastic bag 2 and which is a continuous sealing band creating a tight seal at the top border 9 of the bag 2.

Figure 14A:
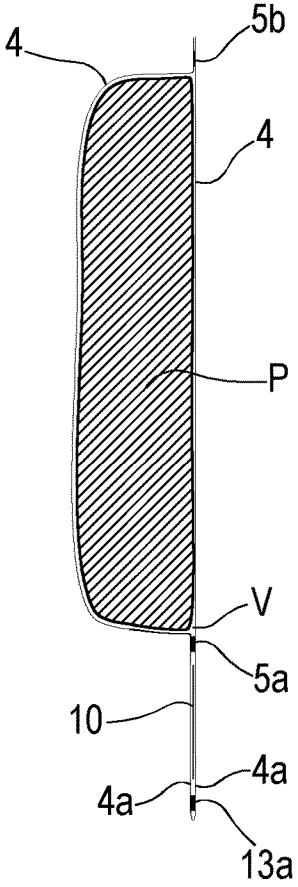
Figure 14:
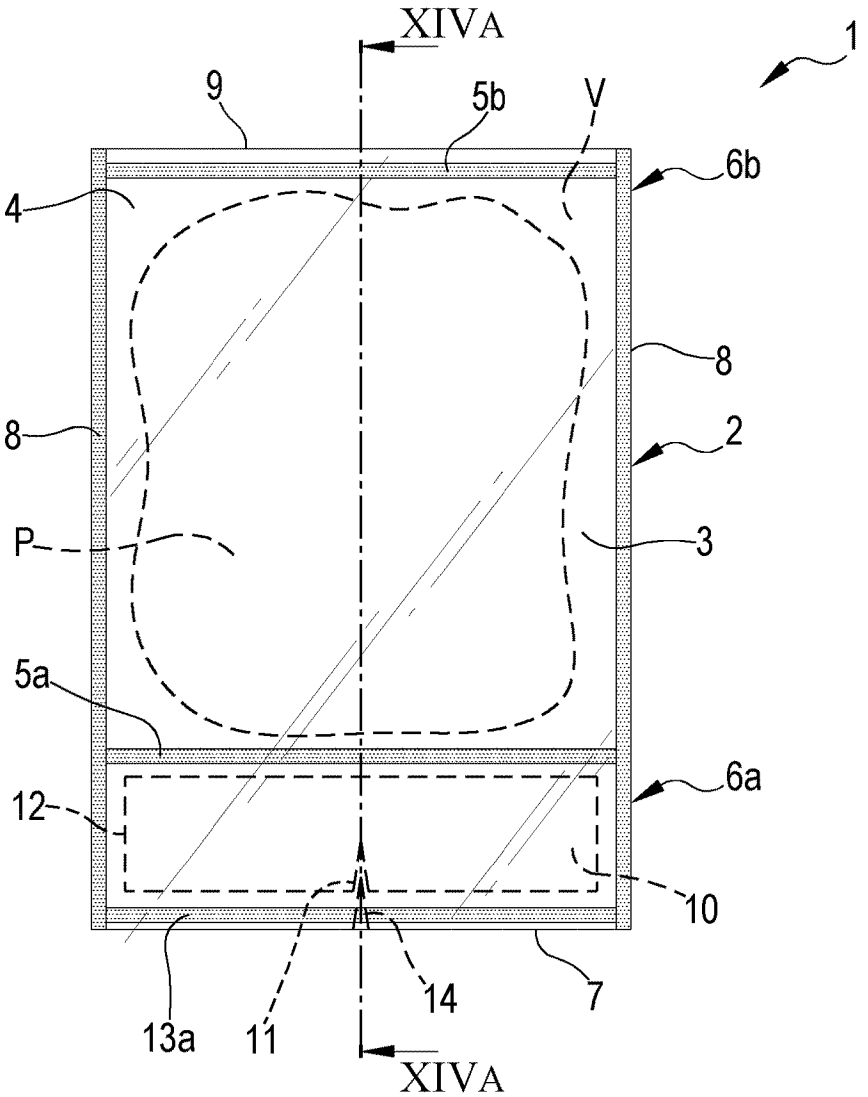

As it can be seen from the figures, in FIGS. 14, 14A the tab 10 is trapped between the opposed wall portions 4*a* and between a first and a second continuous sealing band 5*a*, 13*a* optionally extending parallel to the bend zone or fold line 7.

Figure 15A:
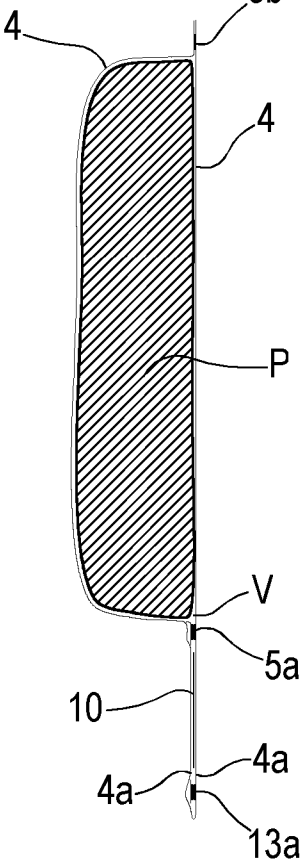
Figure 15:
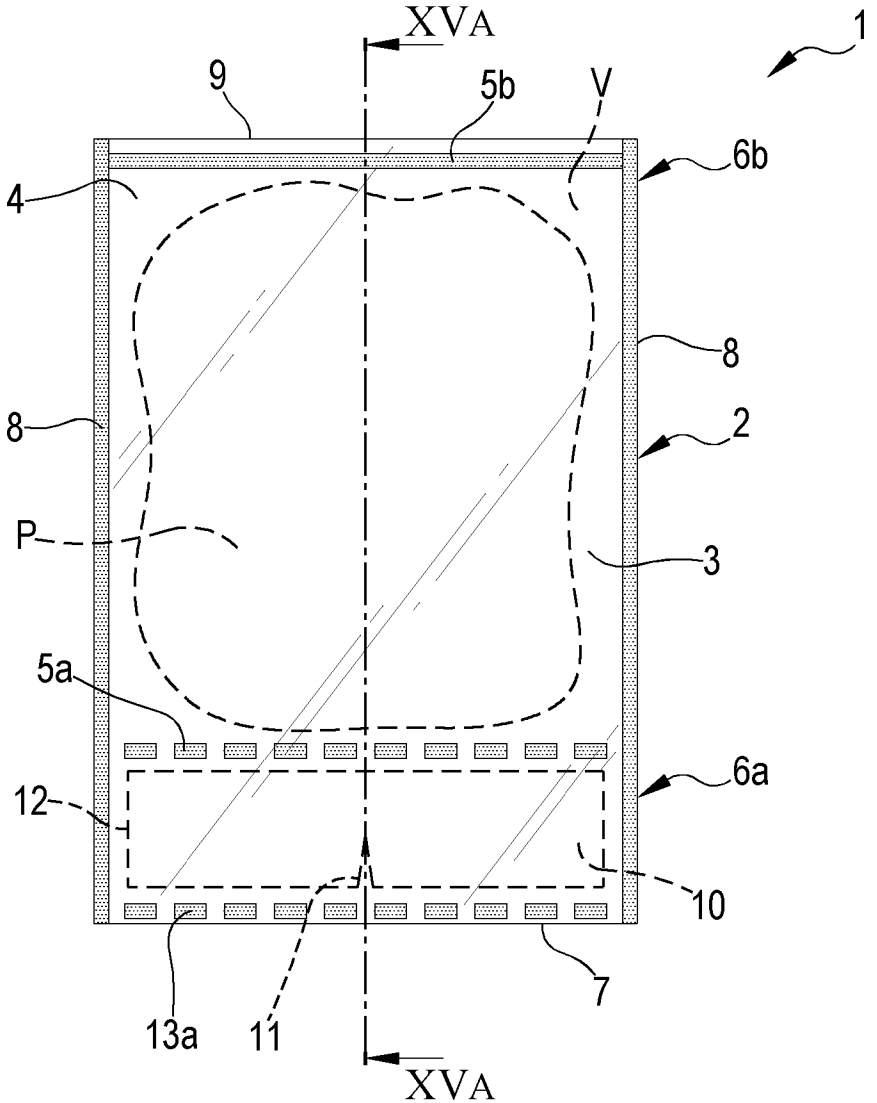

In FIGS. 15, 15A the tab 10 is trapped between the opposed wall portions 4*a* and between a first and a second non-continuous sealing band 5*a*, 13*a* (i.e. each sealing band 5*a*, 13*a* is formed by sealing zones intercalated by non-sealing zones) optionally extending parallel to the bend zone or fold line 7.

Figure 17A:
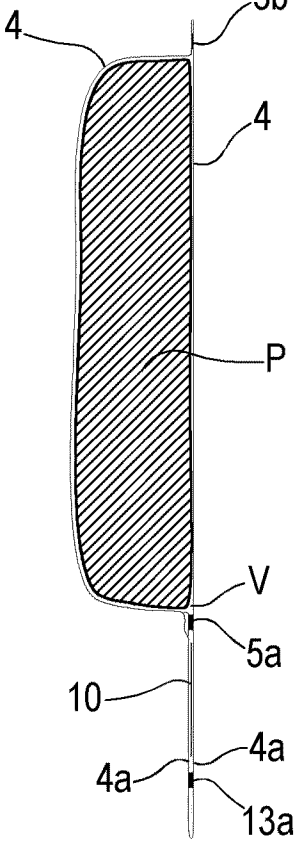
Figure 17:
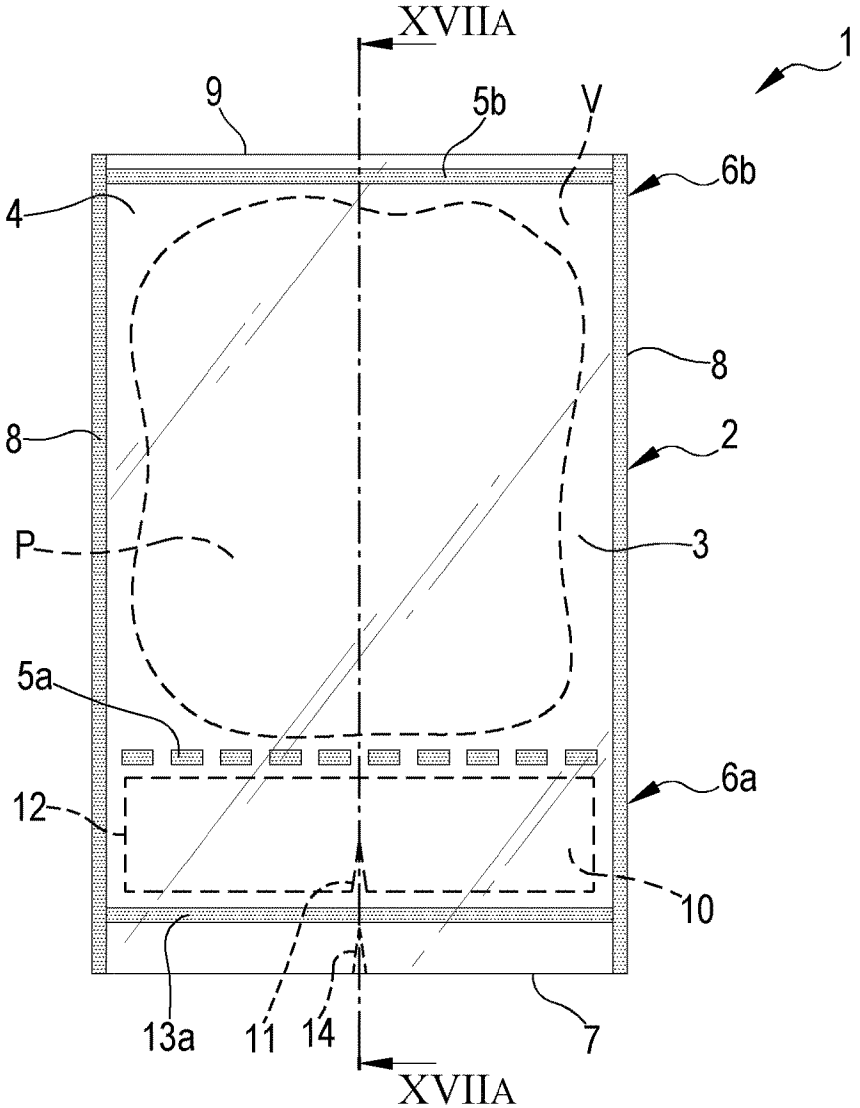

In FIGS. 17, 17A the tab 10 is trapped between the opposed wall portions 4*a* and between a first non-continuous sealing band 5*a* and a second continuous sealing band 13*a* (i.e. first sealing band 5*a* is formed by sealing zones intercalated by non-sealing zones) optionally extending parallel to the bend zone or fold line 7.

Figure 16A:
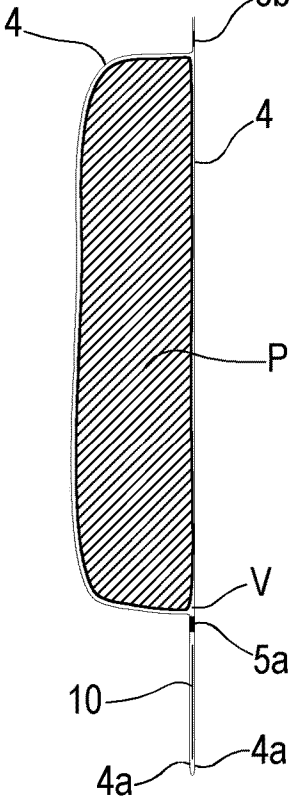
Figure 16:
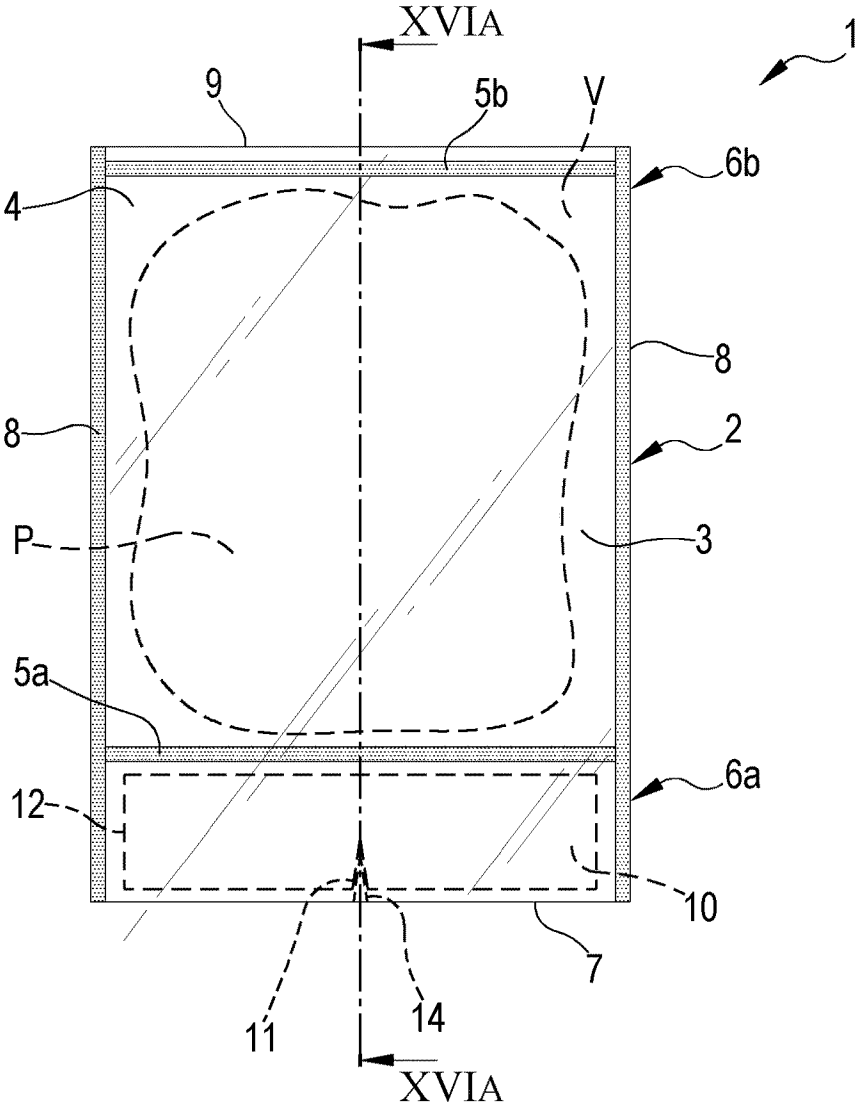

In FIGS. 16, 16A the tab 10 is trapped between the opposed wall portions 4*a* and between a continuous sealing band 5*a* (optionally parallel to bend zone 7) and the bend zone or fold line 7.

Figure 18A:
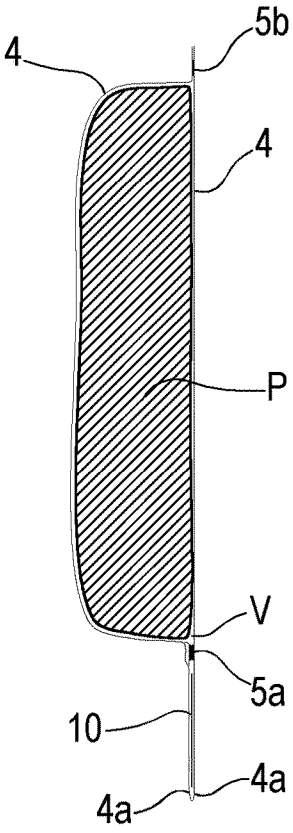
Figure 18:
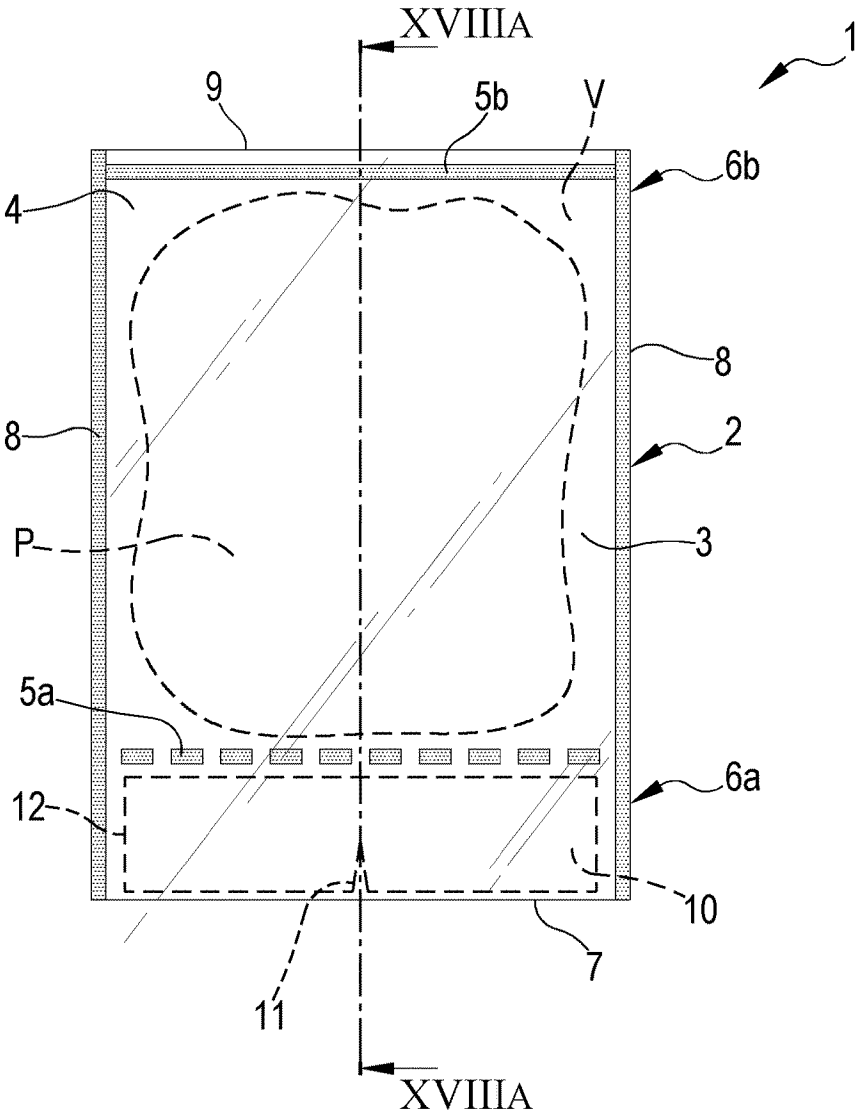

In FIGS. 18, 18A the tab 10 is trapped between the opposed wall portions 4*a* and between a non-continuous sealing band 5*a* (formed by sealing zones intercalated by non-sealing zones and optionally parallel to bend zone 7) and the bend zone or fold line 7.

Apart from the peculiarities described above, the remaining features of the packages of FIGS. 14-18, 14A-18A correspond to those of the first embodiment of FIGS. 1-5 and thus are not repeated and same reference numbers are used to identify corresponding features.

FIGS. 19-22, 19A-22A schematically show further embodiments, which represent additional variants of the package of FIGS. 6-10 (tab 10 applied externally to the bag wall or walls 4). In practice, in the embodiments of FIGS. 19-22, 19A-22A the tab 10 is applied externally to the bag (as in FIGS. 6-10), but in correspondence of a zone of the bag 2 close to the bend zone or line 7. In these variants the bag has a first connecting zone 6*a* including mutually facing wall portions 4*a* of the first ends of the plastic film walls 4 (i.e. the ends of the film walls proximal or adjacent to the bend zone 7). One sealing band 5*a* extends at a distance from bend zone 7, optionally in a direction parallel to the same bend zone 7.

In the variants of FIGS. 19-22, 19A-22A it is provided a second connecting zone 6*b* (in a position opposite to the bend zone 7) including mutually facing wall portions of second ends of the plastic walls 4: at the second connecting zone 6*b* a respective further sealing band 5*b* is provided which extends across the width of the plastic bag 5 and which is a continuous sealing band creating a tight seal at the top border 9 of the bag 2.

Figure 19A:
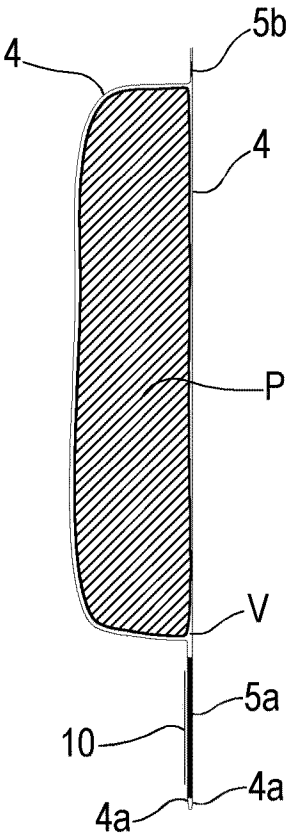
Figure 19:
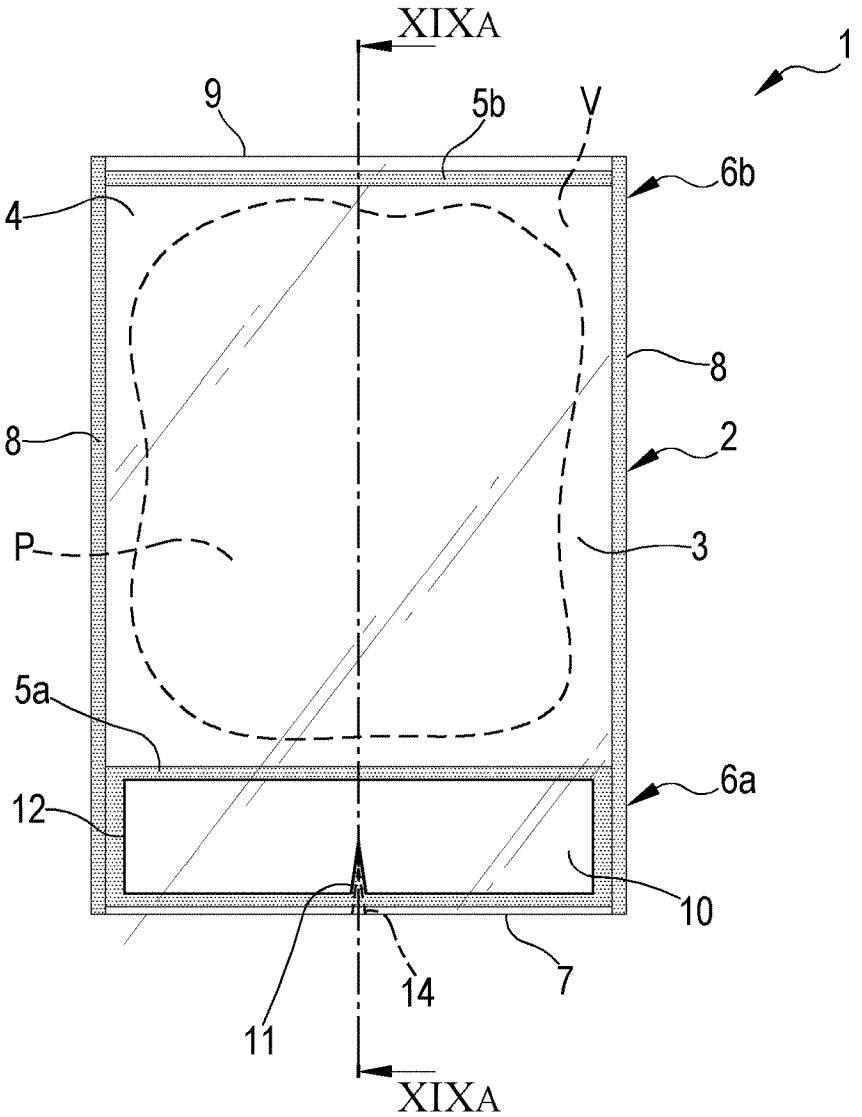

As it can be seen from the figures, in FIGS. 19, 19A the tab 10 is bonded (e.g., glued or hot bonded) to the external surface of the first end of a wall portion 4 above the first continuous sealing band 5*a*, which optionally extends parallel to the bend zone or fold line 7. In this case the first sealing band 5*a* has a width larger than or equal to the width of the tab 10 which may completely or partially overlap the sealing band 5*a* (width is measured parallel to the transverse seal lines or in any case perpendicular to the direction of prevalent extension of the tab 10/sealing band 5*a*). The easy opening feature 11 is a notch, a cut, or a weakening line extending across a portion of the tab 10 and departing from the edge 12 of the tab adjacent to the bend zone or fold line 7.

Figure 20A:
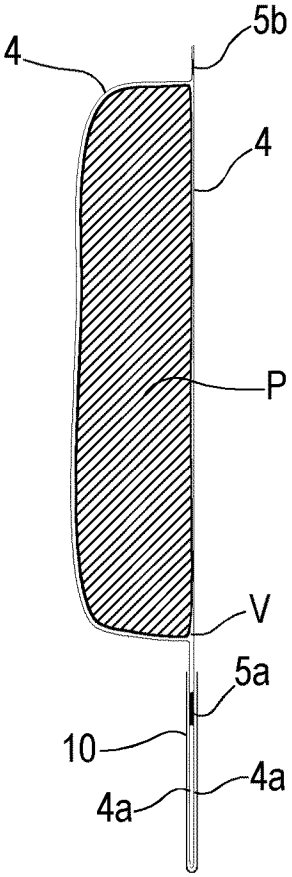
Figure 20:
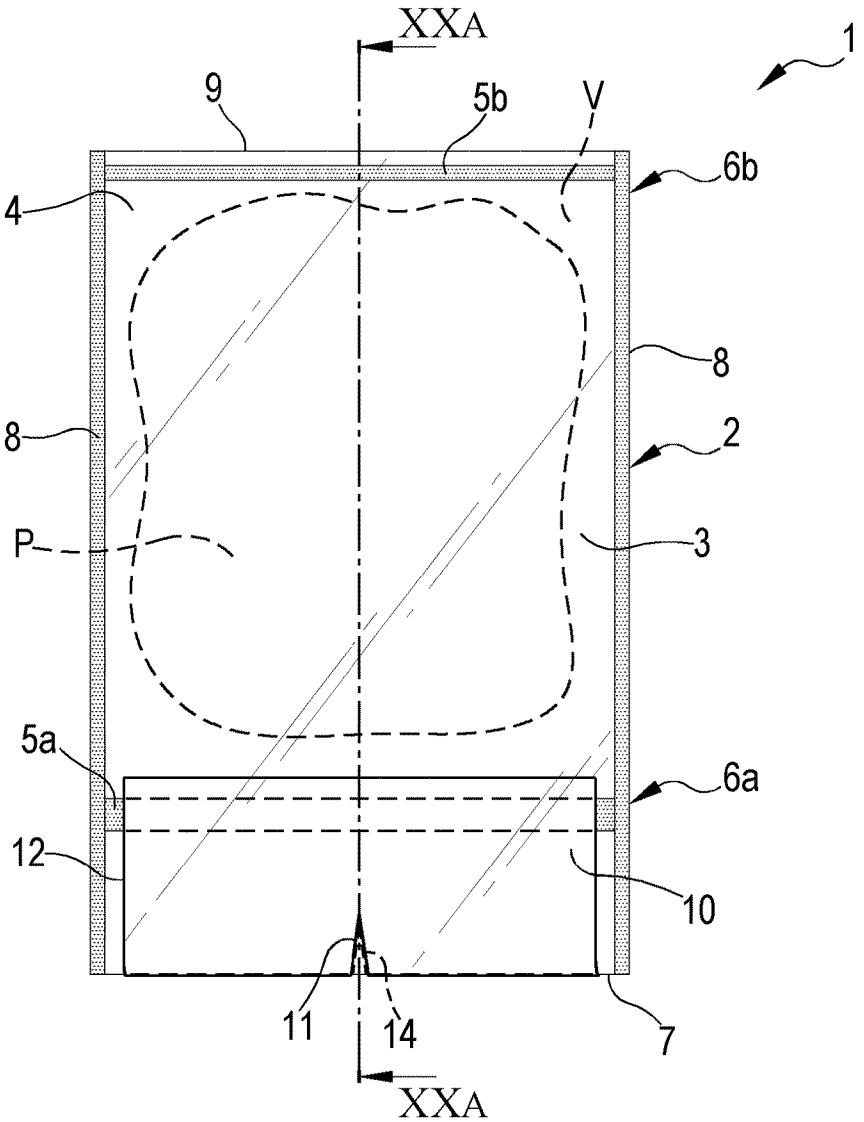

In FIGS. 20, 20A the tab 10 is a folded tab and has two portions each one bonded (e.g., glued or hot bonded) to one respective external surface of the first end of a respective wall portion 4. In this example each portion of the tab has a width larger than the width of the underling first continuous sealing band 5*a* (width is measured parallel to the transverse seal lines or in any case perpendicular to the direction of prevalent extension of the tab 10/seal line 5*a*), which optionally extends parallel to the bend zone or fold line 7. In practice, each portion of the folded tab 10 may completely or partially overlap the sealing band 5*a*. The easy opening feature 11 is a notch, a cut, or a weakening line extending across a portion of both the tab opposed portions and departing from the edge 12 of the tab, which corresponds to the tab folding line positioned just adjacent to the bend zone or fold line 7 of bag 2.

Figure 21A:
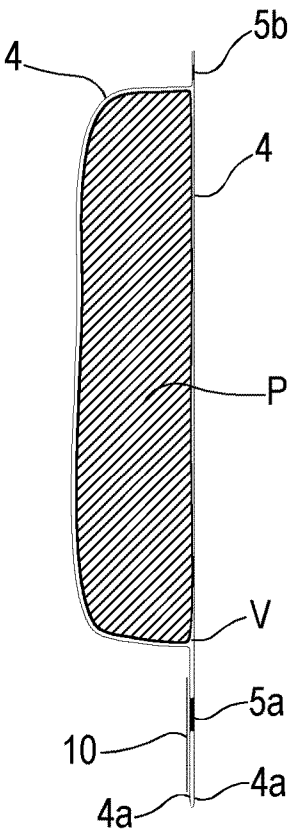
Figure 21:
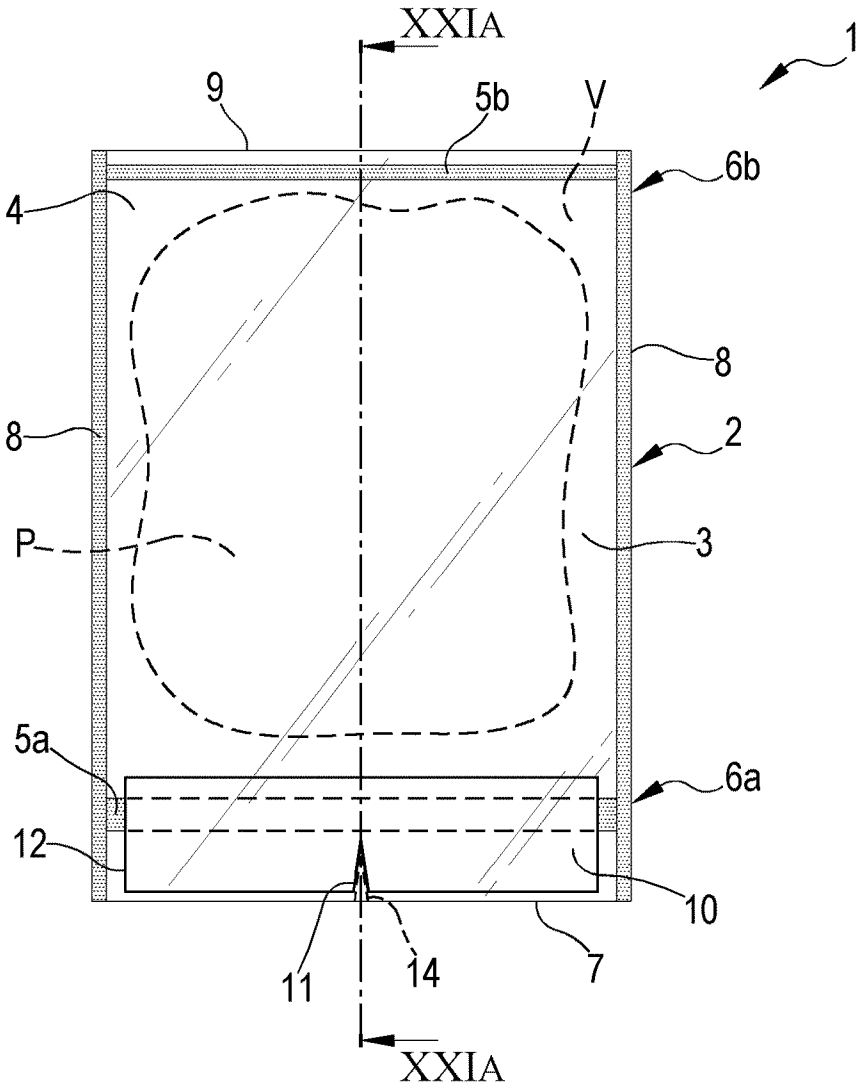

The embodiment of FIGS. 21, 21A is identical to that of FIGS. 19-19A with the exception that the first sealing band 5*a* has a width smaller than the width of the tab 10 (again width is measured parallel to the transverse seal lines or in any case perpendicular to the direction of prevalent extension of the tab 10/sealing band 5*a*).

Figure 22A:
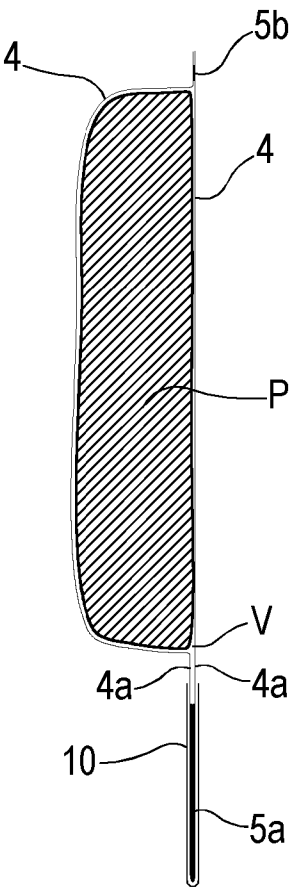
Figure 22:
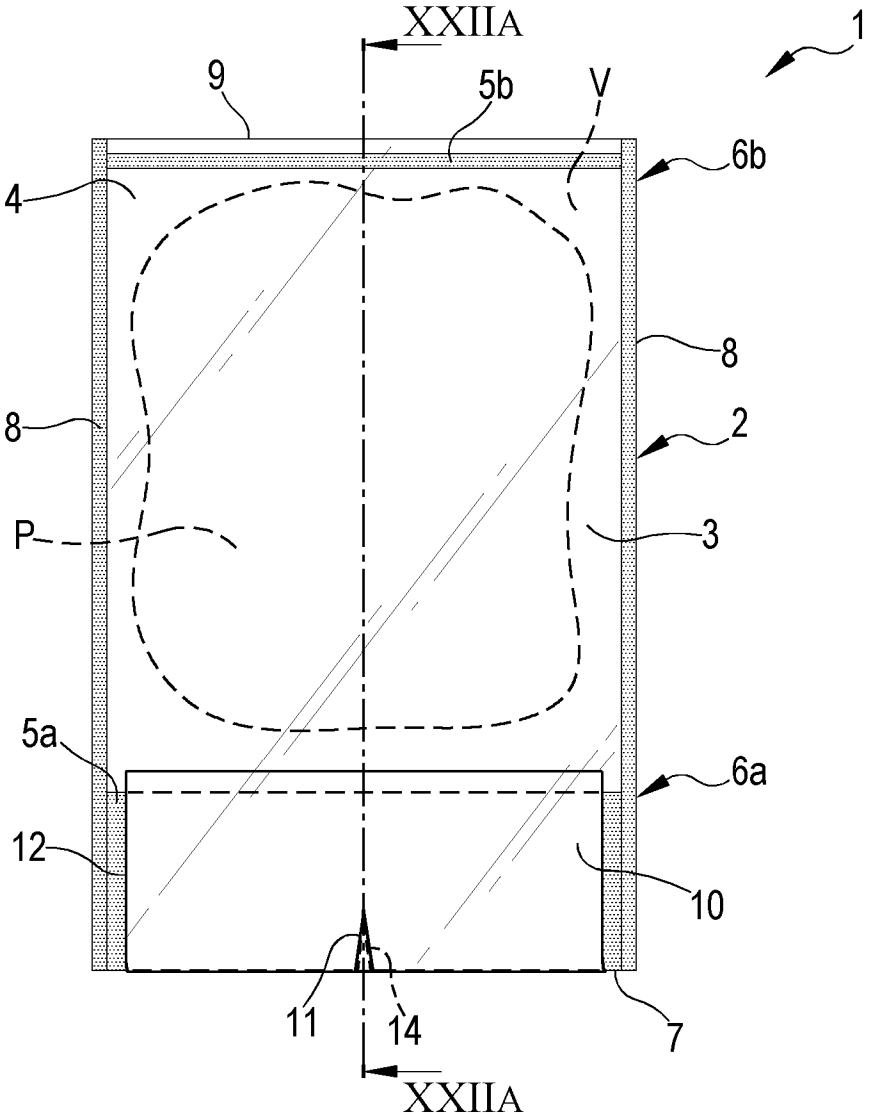

The embodiment of FIGS. 22, 22A is identical to that of FIGS. 20-20A with the exception that in this example each portion of the tab has a width equal to or smaller than the width (again width is measured parallel to the transverse seal lines or in any case perpendicular to the direction of prevalent extension of the tab 10/sealing band 5*a*) of the underling first continuous sealing band 5*a*.

Apart from the peculiarities described above, the remaining features of the packages of FIGS. 19-22, 19A-22A correspond to those of the second embodiment of FIGS. 6-10 and thus are not repeated and same reference numbers are used to identify corresponding features.

Figure 23A:
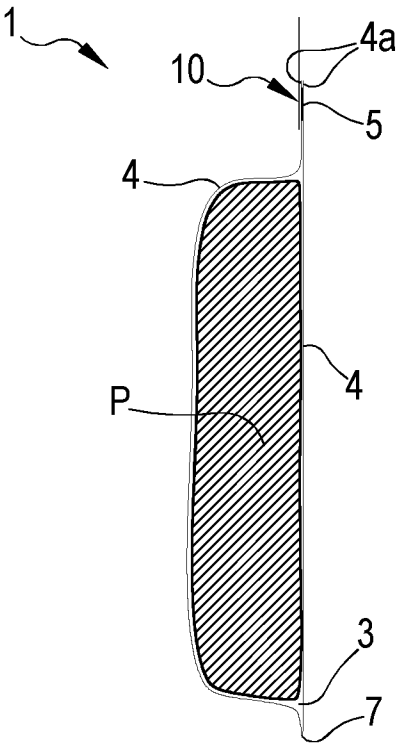
Figure 23:
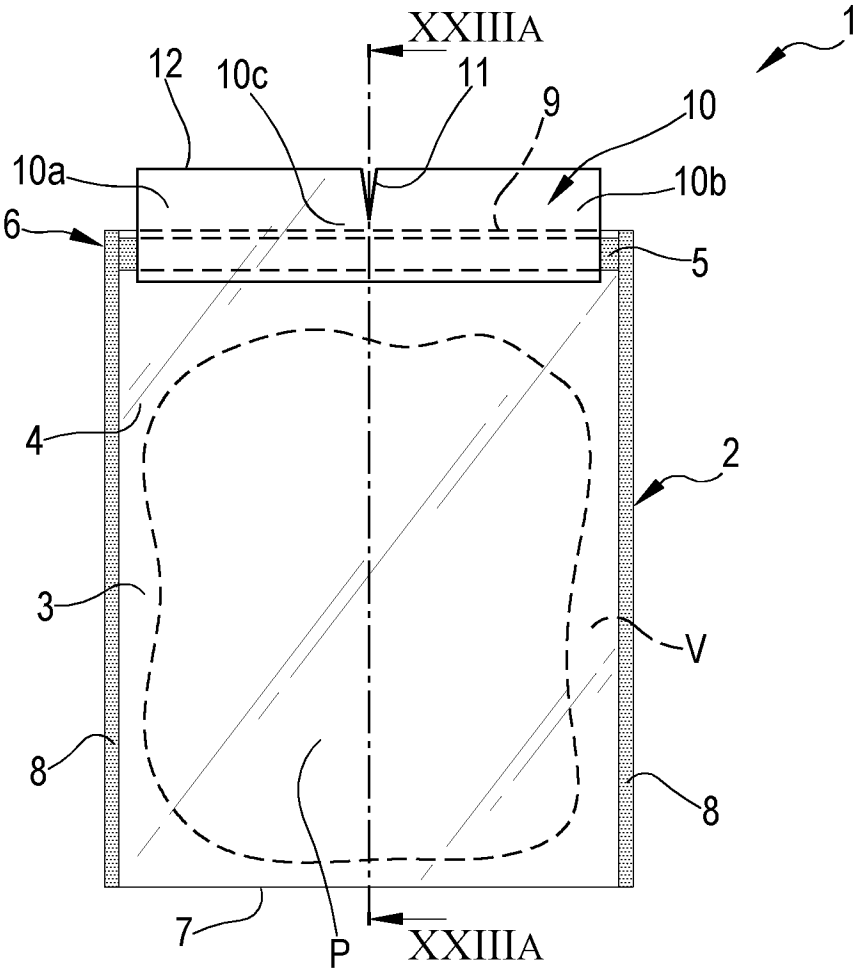

In FIGS. 23, 23A a last embodiment of a package 1 according to other aspects of the invention is shown. The package 1 of FIGS. 23, 23A has the same features of the package of FIGS. 6-10 described above, with the exception that the single sealing band 5 is narrower compared to FIG. 6 and narrower compared to the tab 10: in practice the tab 10 has a length in a direction of prevalent development, preferably parallel to a tab top edge, and has a width measured perpendicular to the direction of prevalent development which is significantly smaller than the length, but larger than the width of the single sealing band 5. Additionally (and different from the example of FIGS. 12, 12A), the tab extends well beyond the top peripheral border 9 of the bag 2 and the easy opening feature 11 on the tab may not reach a zone of the tab overlapping the sealing band 5. Finally, the package may include an optional further easy opening feature (not shown in FIGS. 23, 23A), in particular a further notch, cut or a further weakening line, may be formed in the plastic material of the bag, extend from peripheral border 9 towards said seat 3, be aligned with the easy opening feature 11, and partly cross the sealing band 5.

As the remaining features of the embodiment of FIGS. 23, 23A correspond to those of the second embodiment of FIGS. 6-10, the same reference numerals used in FIGS. 6-10 are adopted and the description thereof is not repeated.

Although in the embodiments described above the package comprises a plastic bag of perfectly rectangular form, this is not necessarily always the case; furthermore, the plastic bag is shown to have a width smaller than its height (with reference to the plane of FIG. 1), but of course the width of the bag may be equal or larger than its height.

Additionally, in variants not shown of the packages described above, the plastic bag 2 may be formed by two separate sheets (instead of one sheet bent along zone/line 7): in this case instead of bend zone 7, there would be a further sealing band, with the rest of the features of the packages 1 described above remaining unchanged.

Process and Apparatus for Making Package 1

Another object of the present invention is a process and a related apparatus for making the package 1.

Figure 24:
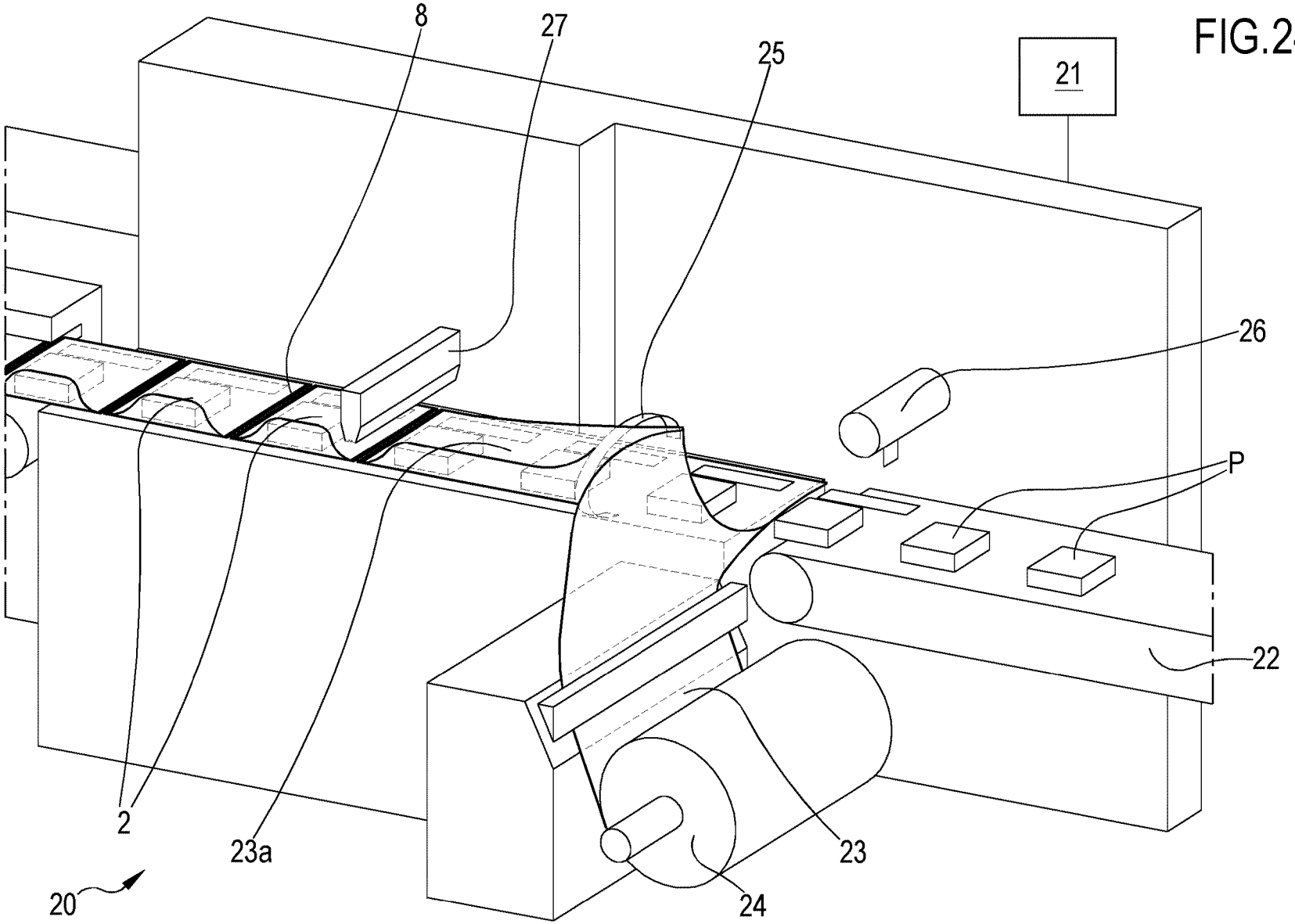
FIGS. 24 and 25 schematically show a first and a second part of the layout of a production line configured to manufacture packages of the type shown in FIGS. 1-5.
Figure 25:
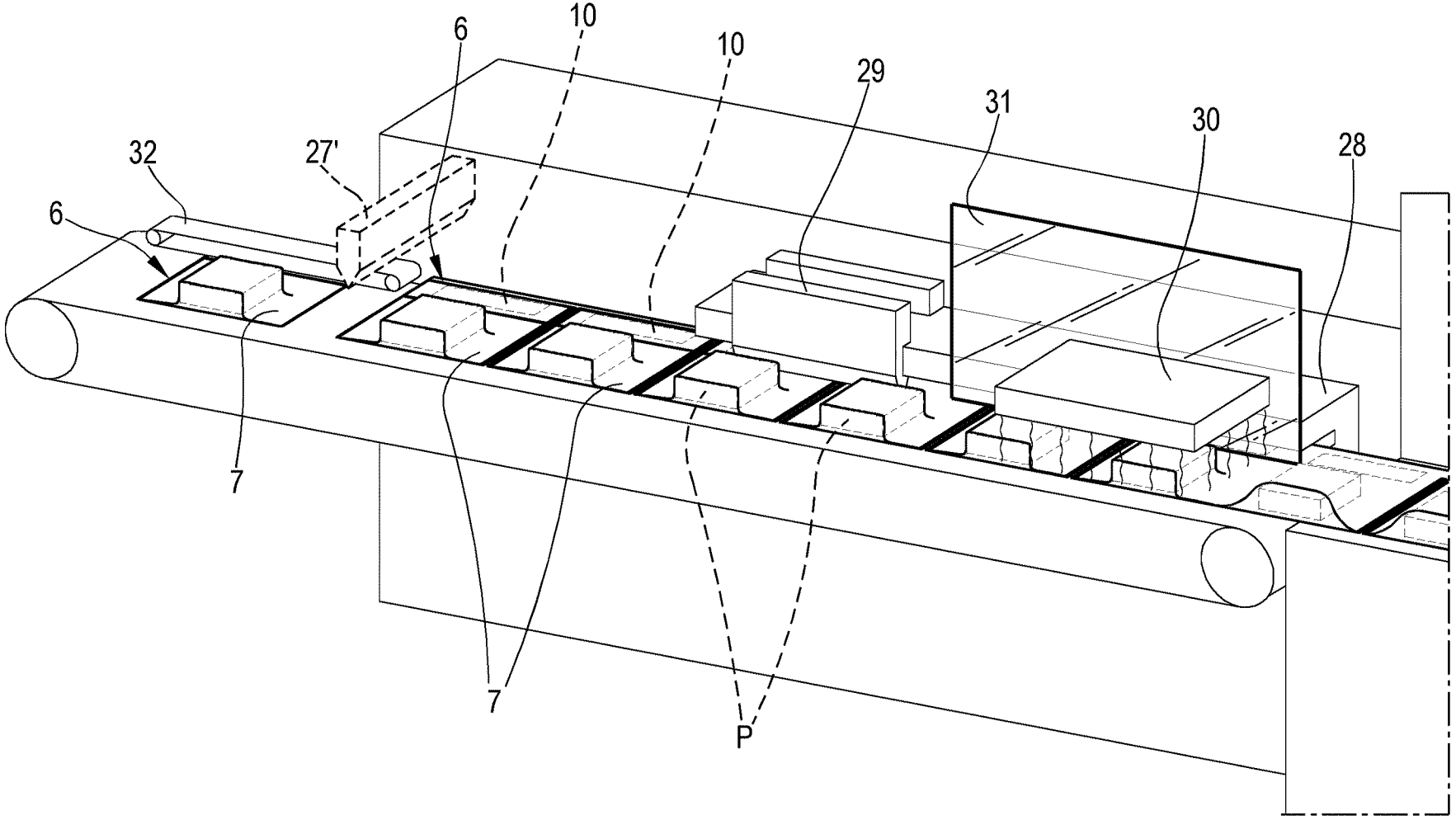

With reference to FIGS. 24 and 25, it is shown an apparatus 20 which, under the control of at least a control unit 21, is configured for executing a process of making the packages of the type shown in FIGS. 1-5, 11-11A. The process comprises advancing products P to be packaged along an operating path: in particular, the products P may be displaced by a conveyor 22, controlled by control unit 21, along said operating path and towards a zone where a film 23 is positioned around the products P. In particular, the film 23 may be fed by a supply roll 24 and displaced along the operating path: before reaching the products P, the film 23 passes through a guide device 25 (for example in the form of a collar) which confers a tubular or almost tubular shape to the film 23 (by almost tubular shape it is intended a shape of a tube with a longitudinal side open). In reality, in the example of FIGS. 24 and 25, the film 23 is not closed as a real tube but has a longitudinal opening on one longitudinal side (the reason for this will be explained herein below) thus conferring an almost tubular shape to the same film downstream the guide device 25 of the tube. Alternatively, the guide device 25 could form the film into a real tube or, in a further alternative, a pre-formed tubular film could be fed from a dedicated supply.

Downstream the guide device 25 the almost tubular film 23*a* advances along the operating path and is positioned around the products P. Upstream the guide device 25 (i.e., when the film is still flat or substantially flat) or at the guide device or immediately downstream the guide device, a tab applicator 26 operates to position a respective tab 10 in correspondence of an area of the film 23 destined to form the connecting zone of each plastic bag. Each tab may be positioned as a discrete tab or in the form of a continuous strip (in this case consecutive portions of the same strip define the tab for each bag under formation). The tabs may be simply positioned or glued or slightly heat bonded to the film 23.

The apparatus 20 then provides, again under control of unit 21, for actuating a seal bar 27 configured to form transversal seals 8, oriented transversally to a direction of advancement of the film 23 along the operating path.

In a first alternative, the seal bar 27, as the tubular or almost tubular film advances, forms spaced apart transverse seals thus creating a plurality of consecutive interconnected plastic bags 2, which are positioned adjacent to each other along said operating path and which are open in correspondence of the area which will become the connecting zone 6 in the final packages. In other words, at this stage of the process, the interconnected bags 2 may be semi-sealed interconnected bags having an opening (which in the specific example is positioned on the left side of the bags with respect to an advancement direction, but which could alternatively be on the right side on the top side or on the bottom side depending on the apparatus design and specifically on the position of the vacuum station destined to suck gas from the interconnected semi-sealed bags). The semi-sealed bags may then be separated from each other by a blade 27' after removal of gas from the bags and after having sealed the opening or open end portion of each bag through which gas is extracted. Each one of the plurality of consecutive plastic bags formed from the tubular or almost tubular film 23*a* hosts a respective product and proceeds to a vacuum station 28, where the open end portions of each bag 2 enter into one or more vacuum chambers which evacuate gas from the bags. Once the bags have been vacuumized, they reach a sealing station 29 where the first and second sealing bands 5 and 13 are formed thereby sealing the seat 3 of each bag 2; moreover, as the tabs 10 had been positioned well before formation of the sealing bands 5 and 13, each respective tab is sandwiched between the inner surfaces of the opposed wall portions 4*a* of the corresponding plastic bag 2 and trapped between the two sealing bands 5, 13.

In a second alternative to what just described, the seal bar 27 may be configured to form both the transversal seals 8, oriented transversally to a direction of advancement of the film 23 along the operating path, and a transverse cut that separates each bag from the consecutive bag. In this case the seal bar 27 (or the seal bars in case more than one seal bar is provided) carries at its bottom two parallel seal bands and a blade positioned between the two seal bands. The seal bar 27 is thus configured, again preferably under the control of control unit 21, to create two parallel transverse seals (as shown in FIG. 24) one forming the left sealing band 8 of an upstream bag under formation and one forming a right sealing band 8 of a downstream bag just formed (with reference to the direction of advancement of the tubular/almost tubular film 23*a* along the operating path shown in FIGS. 24 and 26). The seal bar 27, as the tubular or almost tubular film advances, forms spaced apart transverse seals thus creating a plurality of consecutive already separated plastic bags 2 (although it is not excluded that the blade on the seal bar 27 may be designed to leave a small connection between adjacent bags such as a small plastic tab which is then broken at the end of the process), which are positioned adjacent to each other along said operating path and which are open in correspondence of the area which will become the connecting zone 6 in the final packages. In other words, at this stage of the process, the bags 2 are semi-sealed bags having an opening (which in the specific example is positioned on the left side of the bags with respect to an advancement direction, but which could alternatively be on the right side on the top side or on the bottom side depending on the apparatus design and specifically on the position of the vacuum station destined to suck gas from the interconnected semi-sealed bags). The blade 27' in this alternative is not necessary. As it is visible from FIGS. 24, 25, each one of the plurality of consecutive plastic bags 2 formed from the tubular or almost tubular film 23*a* hosts a respective product and proceeds to vacuum station 28, where the open end portions of each bag 2 enter into one or more vacuum chambers which evacuate gas from the bags. Once the bags have been vacuumized, they reach a sealing station 29 where the first and second sealing bands 5 and 13 are formed thereby sealing the seat 3 of each bag 2, as already described.

In accordance with a further aspect, the process provides a step of heat treating the portion of each consecutive bag where said seat 3 is defined (i.e., basically the main part of each bag with the exclusion of the part destined to define the connecting zone in the final package) to heat shrink said portion of each consecutive bag around the respective product. This heat treating step may be performed using a heat generator 30, such as a hot air generator or an IR heater, or other type of heater operative at or upstream the vacuum station 28. The step of heat treating does not involve heat treating the portion of each bag destined to form the connecting zone, which is maintained thermally insulated from any heat source or sources, for example using a thermal screen or a thermal insulator 31 interposed between the heat generator and the portion of film 23 destined to form the connecting zone of each bag. In greater detail, the above step of heat treating takes place on each package under formation before or during step of withdrawing gas from said plastic bags, and in any case preferably before sealingly close the seats 3 of the plastic bags. In the example shown, the step of heat treating is achieved using hot air, optionally hot air at a temperature comprised between 100° C. and 200° C., in particular from 130° C. and 160° C.

In accordance with a further aspect, the process may include an additional step of heat treating, which takes place after sealingly close the plastic bags and after the tabs are fixed to the respective connecting zones of each plastic bag: in greater detail the additional heat treating is designed to exclusively heat treating the connecting zone of each bag to heat shrink the same connecting zone and cause contraction of the film material against the tab 10, which thus efficiently maintains the material flat and smooth. The additional heating step is achieved using an additional heater 32, for example and additional hot air generator conveying hot hair exclusively to the connecting zone 6, optionally operative to provide hot air at a temperature comprised between 100° and 200° C., in particular from 130° C. and 160° C. Alternatively, and as shown in FIG. 25, the additional heater 32 may comprise a heated belt acting in contact on the connecting zone or a pair of heated belts acting on opposite sides of each interconnected plastic bag. For example each heated belt of the additional heater 32 may have a width of at least 10 mm or of at least 20 mm, preferably comprised between 20 and 40 mm and may be heated to a temperature from 100° C. and 200° C., in particular from 130° C. and 160° C. in the tract of the belt(s) in contact with the bag connecting zone 6. The heated belt(s) may be made in Teflon or at least have a surface acting in contact with the plastic bags 2 covered with a layer of Teflon.

Finally, the process may provide for separating the plastic bags from each other (if the bags are still interconnected) to form packages described herein above with reference to FIGS. 1-5. Alternatively to what described above instead of the additional heater in line with the rest of the apparatus 20, the connecting zone may be heated to cause shrinking at a station separate from the line shown in FIGS. 23 and 24.

Although the above process is suitable to make the packages of FIGS. 1-5, those skilled in the art will understand that the same process may also be used for making the packages of FIGS. 11, 11A (simply the sealing bars 29 will be designed to create at least one non-continuous sealing band 13, or for making the packages of FIGS. 14 to 18 (in this case the tab will be positioned next to the bend zone or fold line 7 and the seal bars 29 will be positioned and designed to form the first and second connecting zones 6*a*, 6*b* described above in connection with the examples of FIGS. 14-18).

Figure 26:
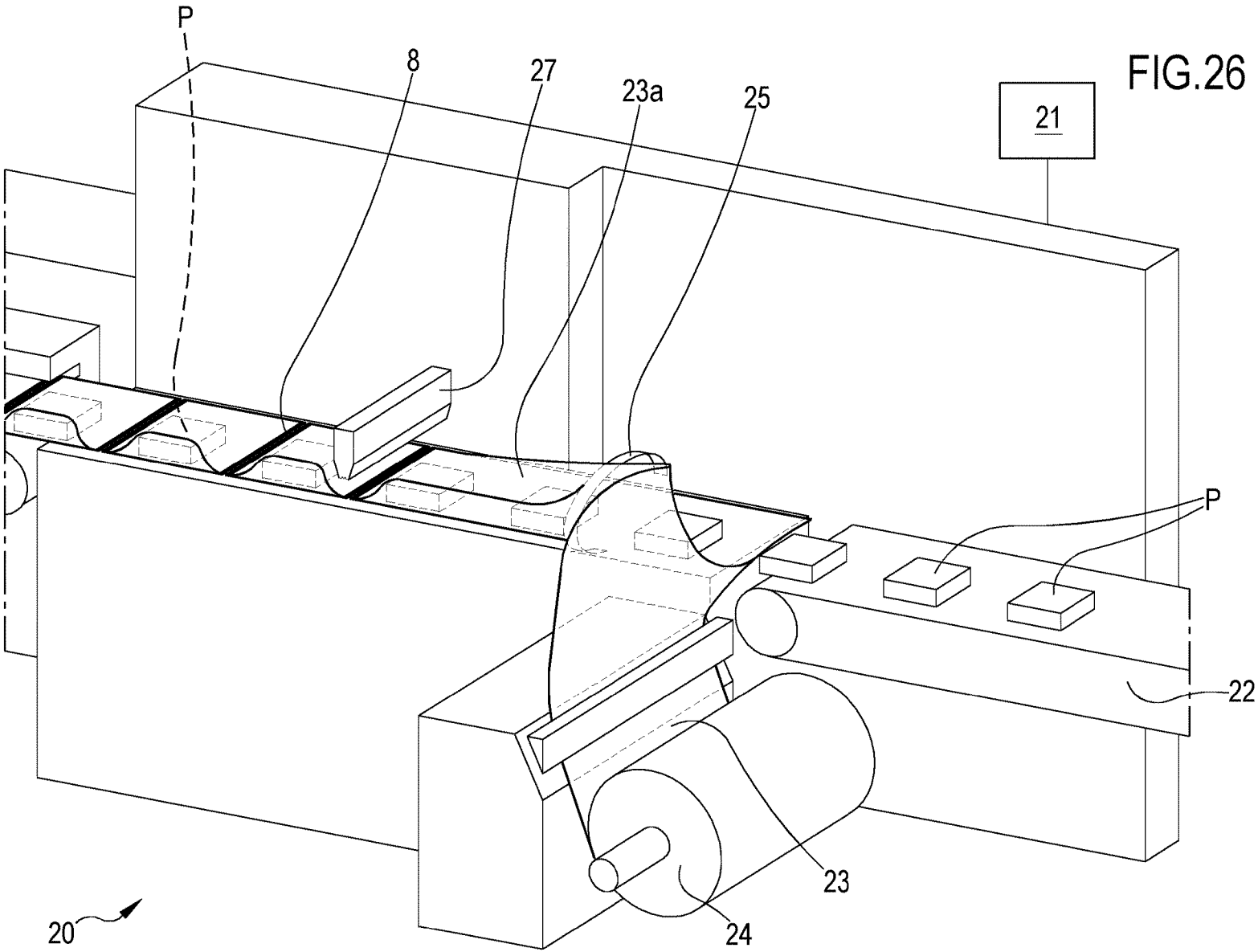
FIGS. 26 and 27 schematically show a first and a second part of the layout of a production line configured to manufacture packages of the type shown in FIGS. 6-10.
Figure 27:
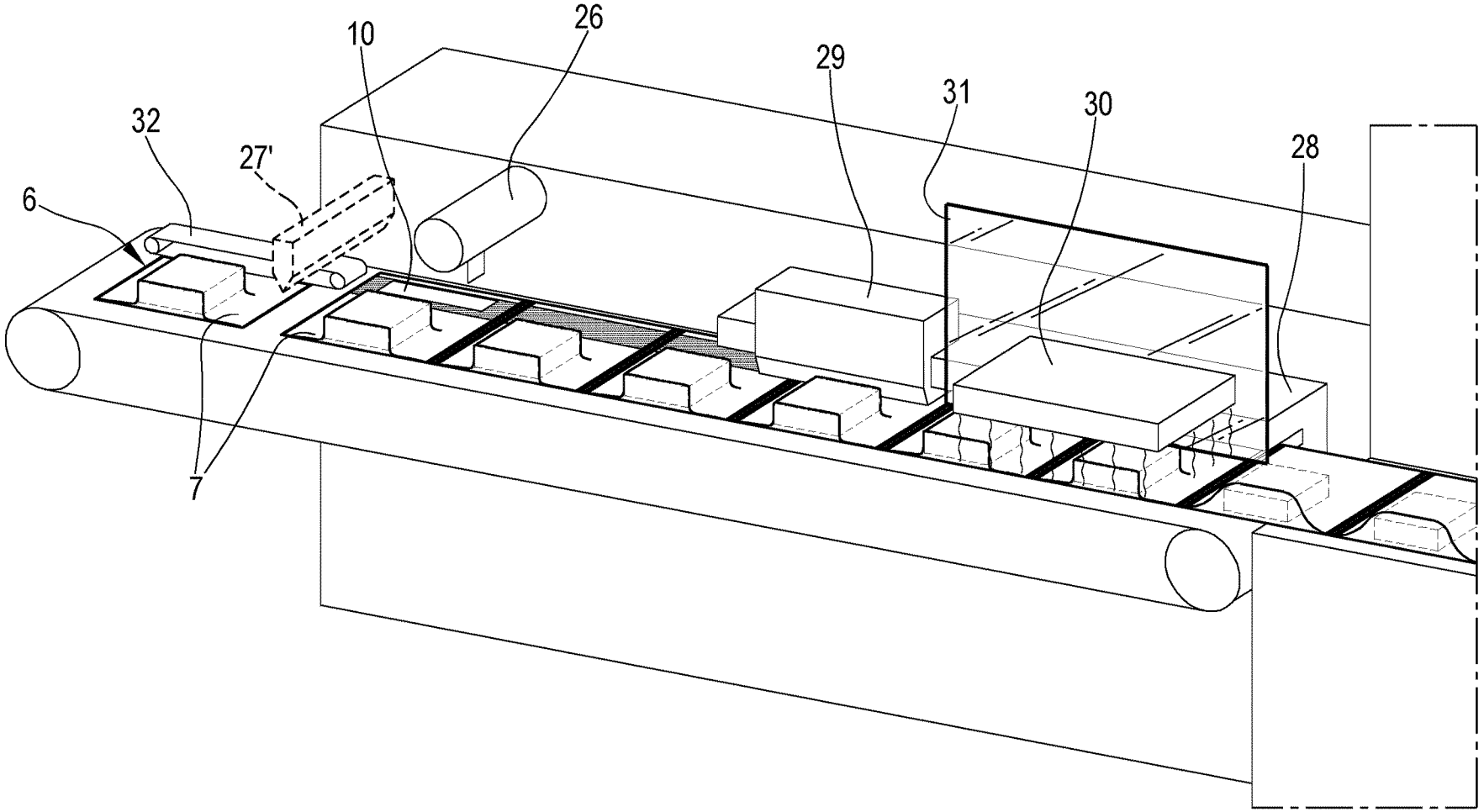

With reference to FIGS. 26 and 27, it is shown an alternative apparatus 20 which, under the control of at least a control unit 21, is configured for executing a process of making the packages of the type shown in FIGS. 6-10. Similar to the above described process, the process executed by the apparatus 20 of FIGS. 26 and 27 comprises advancing products P to be packaged along an operating path: in particular the products P may be displaced by a conveyor 22, controlled by control unit 21, along said operating path and towards a zone where a film 23 is positioned around the products P. In particular, the film 23 may be fed by a supply roll 24 and displaced along the operating path: before reaching the products P, the film 23 passes through a guide device 25 (for example in the form of a collar), which confers a tubular or almost tubular shape to the film 23. In reality, in the example of FIG. 26, the film 23 is not closed as a real tube but has a longitudinal opening on one longitudinal side (to allow evacuation of air in the subsequent vacuum station 28) thus conferring an almost tubular shape to the same film downstream the guide device 25 of the tube. Alternatively, the guide device 25 could form the film into a real tube or, in a further alternative, a pre-formed tubular film could be fed from a dedicated supply.

Downstream the guide device 25 the tubular or almost tubular film 23*a* advances along the operating path and is positioned around the products P.

The apparatus 20 then provides, again under control of unit 21, for actuating one or more seal bars 27 configured to form transversal seals, oriented transversally to a direction of advancement of the film 23 along the operating path. Also in the example of FIGS. 26 and 27 the seal bar 27 may be according to one or the other of the two alternatives described above in connection with the example of FIGS. 24 and 25. The seal bars 27, as the tubular or almost tubular film advances, form spaced apart transverse seals 8, thus creating a plurality of consecutive interconnected plastic bags 2 (which are then separated from each other by blade 27'), which are positioned adjacent to each other along said operating path and which are open in correspondence of the area which will become the connecting zone in the final packages. Alternatively, the seal bar 27 may include two (e.g., bottom) adjacent seal bands and a blade interposed between the adjacent seal bands (thus blade 27' may not be necessary) and thus form separated bags 2 with sealing bands 8 and with an open end portion, as described above for the second alternative of example of FIGS. 24 and 25. As it is visible from FIGS. 26 and 27, each one of the plurality of consecutive plastic bags formed from the tubular or almost tubular film 23 hosts a respective product P and proceeds to a vacuum station 28, where the open end portions of each bag enter into one or more vacuum chambers which evacuate gas from the bags. Once the bags have been vacuumized, they reach a sealing station 29 where the single sealing band 5 is formed thereby sealing the seat 3 of each bag 2.

In accordance with a further aspect, the process executed by the apparatus of FIGS. 26 and 27 provides a step of heat treating the portion of each consecutive bag where said seat 3 is defined (i.e., basically the main part of each bag with the exclusion of the part destined to define the connecting zone in the final package) to heat shrink said portion of each consecutive bag around the respective product. This heat treating step may be performed using a heat generator 30, such as a hot air generator or an IP heater, operative at or upstream the vacuum station 28. The step of heat treating does not involve heat treating the portion of each bag destined to form the connecting zone which is maintained thermally insulated from any heat source or sources, for example using a thermal screen or a thermal insulator 31 interposed between the heat generator and the portion of film 23 destined to form the connecting zone of each bag. In greater detail, the step of heat treating takes place on each package under formation before or during step of withdrawing gas from said plastic bags, and in any case preferably before sealingly close the seats 3 of the plastic bags. Also in the example of FIG. 27, the step of heat treating is achieved using hot air, optionally hot air at a temperature comprised between 100° and 200° C., in particular from 130° C. and 160° C.

Then the process of FIG. 27 provides for positioning a respective tab 10 in correspondence of the connecting zone of each plastic bag: this step takes place for example by action of tab applicator 26 after having sealingly closed each bag: each tab 10 is fixed, in particular adhesively or heat bonded, to the outer surface one or both of the opposed wall portions 4*a* of each plastic bag 2 at connecting zone 6.

In accordance with a further aspect, also the process of FIGS. 26 and 27 may include an additional step of heat treating, which takes place after sealingly close the plastic bags and after the tabs are fixed to the respective connecting zones of each plastic bag: in greater detail the additional heat treating is designed to exclusively heat treating the connecting zone of each bag to heat shrink the same connecting zone and cause contraction of the film material against the tab, which thus efficiently maintains the material flat and smooth. The additional heating step is achieved using an additional heater 32, for example and additional hot air generator, optionally operative to provide hot air at a temperature comprised between 100° and 200° C., in particular from 130° C. and 160° C.

Alternatively, and as shown in FIG. 27, the additional heater 32 may comprise heated belt acting in contact on the connecting zone or a pair of heated belts acting on opposite sides of each interconnected plastic bag. For example each heated belt of the additional heater 32 may have a width of at least 10 mm or of at least 20 mm, preferably comprised between 20 and 40 mm and may be heated to a temperature from 100° C. and 200° C., in particular from 130° C. and 160° C. in the tract of the belt(s) in contact with the bag connecting zone 6.

The heated belt(s) may be made in Teflon or at least have a surface acting in contact with the plastic bags 2 covered with a layer of Teflon.

Finally, the process may provide for separating the plastic bags from each other (if the bags are still interconnected) to form packages described herein above with reference to FIGS. 6-10.

Alternatively to what described above, instead of the additional heater in line with apparatus 20, the connecting zone may be heated to cause shrinking at a station separate from the line shown in FIGS. 26 and 27.

Although the above process and apparatus of FIGS. 26 and 27 is suitable to make the packages of FIGS. 6-10, those skilled in the art will understand that the same process may also be used for making the packages of FIGS. 12, 12A (the sealing bar 29 will be designed to create a sealing band 13 narrower than that of FIG. 6), or the packages of FIGS. 13, 13A (the sealing bar 29 will in this case be designed to create a sealing band 5 narrower than that of FIG. 6 and the tab applicator will be designed to apply a tab folded on both sides of each bag), or the packages of FIGS. 23, 23A (the sealing bar 29 will in this case be designed to create a sealing band 5 narrower than that of FIG. 6 and the tab applicator will be designed to apply a tab extending beyond the peripheral edge 9 of the bag 2), or the packages FIGS. 19 to 22 (in this case the tab will be positioned next to the bend zone or fold line 7 and the seal bars 29 will be positioned and designed to form the first and second connecting zones 6*a*, 6*b* described above in connection with the examples of FIGS. 19-22).

In the processes and packages described above the tab is a made, in particular entirely made, of paper, or paperboard, or non-heat-shrinkable plastic material; furthermore the tab has thickness greater than the thickness of the plastic film material used in the process to form the plastic bags 2. In particular, the thickness of the tab is between 35 and 400 μm, whilst the plastic film material has thickness comprised between 10 and 60 μm, optionally between 15 and 45 μm, more optionally between 20 and 35 μm.

Finally, although the attached drawings show an apparatus where the products and the bags under formation are moved along a horizontal operating path, nothing excludes that the packages disclosed herein might be obtained using a vertical type machine where a film is shaped according to a tubular shape and moved along a vertical trajectory. In this case the film may for example come from a feed roll, be shaped by a guide device (for example in the form of a collar) which confers a tubular or almost tubular shape to the film (by almost tubular shape it is intended a shape of a tube with a longitudinal, in this case vertical, side open) such as to have opposed longitudinal edges which are then sealed by a sealer operative an a side of the tubular film. Transverse (i.e., in this case horizontal) seals are then carried out on the tubular film to form a plurality of interconnected packages. Before making the top transverse seal on each package a product is position or fed into each semi-sealed package and, if desired, each package may be vacuumized. As described for the above processes, the body of each package where the product is housed may be heat shrunk (i.e. with hot air) and the connecting zone of each package may also be heat shrunk (separately from the rest of the bag to cause contraction of the film material at the zone where the tab is located). Finally, the interconnected bags are separated to form the packages described above.

Again, although in the above processes, it is described that the heat treatments are achieved with hot air, according to a possible alternative applicable to the above described processes instead or in addition to performing the heat treatments with hot air as above described, the plastic bags, or the packages obtained after separation of the plastic bags, may be heat treated offline at a dedicated heat treatment, using hot air and or hot liquid.

In a further aspect, a process of making packages is disclosed which may be used for making the packages described above or also for making packages without any tab. In practice, it is possible to refer to FIGS. 24-27 where the steps of applying the tab 10 are removed. This last process comprises the following steps:

- advancing a plastic film 23 along an operating path, wherein the plastic film 23 is a heat-shrinkable plastic film for example of the type described above;
- forming a plurality of plastic bags 2 from the plastic film 23, wherein each of the plastic bags 2 has a seat 3 hosting a respective product P;

heat-treating at least a portion of each plastic bag 2 where said seat 3 for a respective product P is defined to heat shrink at least the portion of each plastic bag 2 where the seat 3 is defined;

applying a vacuum to extract gas from said seat 3 via at least one opening in each plastic bag 2 (the opening may be created while forming the bags as in the processes shown in the attached figures or closed bags first be formed and then an opening is created e.g. by cutting or piercing the film of each closed bag to create a passage for gas to be extracted from the bag 2), then sealingly close each plastic bag 2 to form a vacuumized package 1 from each plastic bag.

According to an aspect of this process, vacuumization may start after initiation of the heat shrinking of the portion of the plastic bag where the product is seated (or of the entire plastic bag), which as shown in the figures may take place in line with the step of vacuumization in the same apparatus, for example using hot air acting on the plastic bag portion hosting the product.

In a possible aspect first heat shrinking of the portion of the plastic bag where seat 3 is defined takes place (using hot air) and then vacuumization by applying vacuum to the at least one opening may take place with vacuumization lasting few seconds (e.g., from 0.5 to 2 or 3 seconds) after termination of the heat shrinking step.

Once vacuumization is completed each bag is finally sealed.

The invention claimed is:

1. A process of making packages comprising:

advancing a plastic film (23) along an operating path, forming a plurality of plastic bags (2) from the plastic film (23), each of said plastic bags (2) hosting a respective product (P), obtaining from each of said plastic bags (2) a package, wherein the package comprises a plastic bag (2) delimiting a seat (3) sealingly housing a product (P), the plastic bag (2) having one or more plastic film walls (4), and at least one connecting zone (6; 6*a*, 6*b*) comprising at least one sealing band (5; 5, 13; 5*a*; 5*a*, 13*a*) connecting together mutually facing wall portions (4*a*) of said plastic film walls (4), a tab (10) coupled with the at least one connecting zone (6; 6*a*, 6*b*) of the plastic bag (2), wherein the tab (10) includes an easy opening feature (11) at one or more of its perimeter edges;

the tab (10) having a thickness greater than a thickness of the one or more plastic film walls (4);

wherein the plastic bag (2) comprises a further easy opening feature (14), in particular a further notch or a further cut or a further weakening line;

wherein the further easy opening feature (14) is formed in the plastic material of the plastic bag (2) and extends from a peripheral border (9) of the plastic bag (2), and wherein the further easy opening feature (14) is either adjacent to the connecting zone (6; 6*a*, 6*b*) of the plastic bag (2) or partly crosses the connecting zone (6), in particular partly or completely crosses at least one sealing band (5; 5, 13; 5*a*; 5*a*, 13*a*) of the plastic bag (2); and wherein the process comprises a step of positioning a respective tab (10) in correspondence of the at least one connecting zone (6; 6*a*, 6*b*) of each plastic bag (2) or of positioning a respective tab (10) in correspondence of an area of the plastic film (23) destined to form said at least one connecting zone (6; 6*a*, 6*b*) of each plastic bag (2).

2. The process of claim 1, wherein:

the products (P) to be packaged are advanced along the operating path together with the plastic film (23), the plastic film (23) is positioned around the products (P) before formation of the plastic bags (2), the plastic film (23) being a continuous plastic film shaped into a tubular or in an almost tubular film structure receiving the products (P);

with the process comprising:

forming on the tubular or almost tubular film structure transversal seals (8), oriented transversally to a direction of advancement of the film along the operating path, to define the plurality of consecutive plastic bags (2), which are positioned adjacent to each other along said operating path; wherein each of said consecutive plastic bags (2) delimits a respective seat (3) and is in the form of a semi-sealed plastic bag which has at least one opening, and withdrawing gas from said semi-sealed plastic bags through said opening and then forming said at least one connecting zone (6; 6*a*, 6*b*) of each plastic bag (2) for sealingly closing semi-sealed plastic bags and forming sealingly closed plastic bags (2).

3. The process of claim 1, comprising either positioning the respective tab (10) in correspondence of an area of the plastic film (23) destined to form said connecting zone (6; 6*a*, 6*b*) of each plastic bag (2) by placing the respective tab (10) between mutually facing wall portions of the plastic film (23) before forming the plastic bags (2) such that each respective tab (10), once the plastic bags (2) are formed, is sandwiched between the inner surfaces of the opposed wall portions (4*a*) of the corresponding plastic bag (2);

or positioning the respective tab (10) in correspondence of the connecting zone (6) of each plastic bag (2) by placing the respective tab (10) after having sealingly closed each plastic bag (2) and wherein each tab (10) is fixed, in particular adhesively or heat bonded, to the outer surface one or both of the opposed wall portions (4*a*) of each plastic bag (2).

4. The process of claim 3, wherein each tab (10) is positioned as a discrete tab in correspondence of:

the connecting zone (6; 6*a*, 6*b*) of a respective plastic bag (2), or a respective area of the tubular or almost tubular film structure destined to form the connecting zone (6; 6*a*, 6*b*) of a plastic bag (2), or a respective area of the plastic film (23) before being formed into the tubular or almost tubular film structure, said respective area destined to form the connecting zone (6; 6*a*, 6*b*) of a plastic bag (2);

wherein each tab (10) is a portion of a continuous longitudinal strip which is fed along the operating path in synchrony with said plastic film (23), consecutive portions of said continuous strip destined to form respective tabs (10) being positioned in correspondence of the connecting zone (6; 6*a*, 6*b*) of the respective plastic bag (2) or of a respective area of plastic film destined to form the connecting zone (6; 6*a*, 6*b*) of a plastic bag (2).

5. The process of claim 1, comprising heat treating the portion of each plastic bag where said seat (3) for a respective product (P) is defined to heat shrink said portion of each consecutive bag around the respective product (P);

wherein said step of heat treating the portion of each plastic bag where said seat (3) is defined does not involve heat treating the portion of each plastic bag adjacent to said seat (3) and destined to form said connecting zone (6; 6*a*, 6*b*) to which the tab (10) is coupled which is maintained thermally insulated from any heat source or sources used to heat treat the portion of each plastic bag where said seat (3) is defined, such that the portion of each plastic bag destined to form the connecting zone is not heat shrunk or is heat shrunk significantly less than the portion where said seat (6) is defined;

wherein the step of heat treating takes place before or during step of withdrawing gas from said plastic bags (2) through said opening and before sealingly close the semi-sealed plastic bags and forming sealed plastic bags (2), wherein said step of heat treating is achieved using hot air, optionally hot air at a temperature comprised between 130° C. and 160° C.

6. The process of claim 5, comprising a further step of heat treating, which takes place after sealingly closing the plastic bags (2) and with the tab (10) fixed to the respective connecting zone (6) of each plastic bag (2); said further step of heat treating exclusively heat treating the at least one connecting zone (6; 6*a*, 6*b*) of each plastic bag to heat shrink the same connecting zone (6; 6*a*, 6*b*), optionally wherein said further step of heat treating is achieved using a heated belt acting in contact on the at least one connecting zone (6; 6*a*, 6*b*), or a pair of heated belts acting on opposite sides of the connecting zone of each plastic bag, or using hot air at a temperature comprised between 130° C. and 160° C.

* * * * *